US011777232B2

(12) United States Patent
Smith, Jr. et al.

(10) Patent No.: US 11,777,232 B2
(45) **Date of Patent: *Oct. 3, 2023**

(54) MOBILE MULTI-FREQUENCY RF ANTENNA ARRAY WITH ELEVATED GPS DEVICES, SYSTEMS, AND METHODS

(71) Applicant: Integrity Microwave, LLC, Argyle, TX (US)

(72) Inventors: Richard Loy Smith, Jr., Dallas, TX (US); Wesley Dale Sarratt, Argyle, TX (US)

(73) Assignee: Integrity Microwave, LLC, Argyle, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/590,383

(22) Filed: Feb. 1, 2022

(65) Prior Publication Data

US 2022/0407242 A1 Dec. 22, 2022

Related U.S. Application Data

(63) Continuation of application No. 17/017,614, filed on Sep. 10, 2020, now Pat. No. 11,245,205.

(51) Int. Cl.
*H01Q 21/28* (2006.01)
*H01Q 1/24* (2006.01)
(Continued)

(52) U.S. Cl.
CPC ..... *H01Q 21/28* (2013.01); *H01Q 1/1228* (2013.01); *H01Q 1/246* (2013.01); *H01Q 1/38* (2013.01); *H01Q 21/205* (2013.01)

(58) Field of Classification Search
CPC .... H01Q 21/205; H01Q 21/28; H01Q 1/1228; H01Q 1/246; H01Q 1/1207;
(Continued)

(56) References Cited

U.S. PATENT DOCUMENTS 4,978,965 A 12/1990 Mohuchy
6,014,112 A 1/2000 Koscica et al.
(Continued)

FOREIGN PATENT DOCUMENTS

CN 102013560 4/2011
CN 203690467 7/2014
(Continued)

OTHER PUBLICATIONS

Antennas for Communicaiton, :Radome Transmission Loss and Antenna Pattern Degradation, retrieved on Jun. 4, 2020 in 15 pgs.
(Continued)

*Primary Examiner* — Hoang V Nguyen
(74) *Attorney, Agent, or Firm* — KNOBBE, MARTENS, OLSON & BEAR, LLP

(57) ABSTRACT

A mobile antenna array system has a first baseplate with a first groundplane. An elevated second baseplate defines an elevated second groundplane. A plurality of support antennas are positioned between the first baseplate and the elevated second baseplate. The plurality of support antennas comprise multiple antennas configured to work at different frequencies. The plurality of support antennas are coupled to the first and second baseplates in mechanical connections that provide enhanced stability, tight tolerances, repeatability and low cost through the use of printed circuit boards as substrates for one or more of the antennas and baseplates. An elevated GPS antenna is positioned above the elevated second baseplate in use. The elevated GPS antenna is configured to work within a GPS range of frequencies different from the support antenna ranges of frequencies. The elevated GPS antenna has improved GPS transmissions and the support antennas also have improved positioning and functionality.

20 Claims, 27 Drawing Sheets

(51) Int. Cl.
*H01Q 1/38* (2006.01)
*H01Q 21/20* (2006.01)
*H01Q 1/12* (2006.01)

(58) Field of Classification Search
CPC ..... H01Q 1/3208; H01Q 1/42; H01Q 21/20; H01Q 21/30; H01Q 9/0435; H01Q 9/30
See application file for complete search history.

(56) References Cited

U.S. PATENT DOCUMENTS

| | | | | |
|---|---|---|---|---|
| 6,400,332 | B1 | 6/2002 | Tsai et al. | |
| 6,424,311 | B1 | 7/2002 | Tsai et al. | |
| 6,683,570 | B2 | 1/2004 | Skladany et al. | |
| 6,831,615 | B2 | 12/2004 | Götti | |
| 6,859,176 | B2 | 2/2005 | Choi | |
| 7,336,241 | B2 | 2/2008 | Bailey et al. | |
| 7,427,966 | B2 | 9/2008 | Boss et al. | |
| 7,616,168 | B2 | 11/2009 | Tillery | |
| 7,868,842 | B2 | 1/2011 | Chair | |
| 7,986,280 | B2 | 7/2011 | Semonov | |
| 8,294,613 | B2 | 10/2012 | Stucki | |
| 9,461,370 | B2 | 10/2016 | Yona et al. | |
| 9,609,530 | B2 | 3/2017 | Lea et al. | |
| 9,843,108 | B2 | 12/2017 | Le et al. | |
| 9,859,611 | B2 | 1/2018 | Jones et al. | |
| 9,923,280 | B2 | 3/2018 | Segador et al. | |
| 10,381,750 | B2 | 8/2019 | Jung et al. | |
| 11,245,205 | B1 * | 2/2022 | Smith, Jr. ..... | H01Q 1/1228 |
| 2002/0163476 | A1 | 11/2002 | Eriksson | |
| 2007/0229385 | A1 | 10/2007 | Deng et al. | |
| 2007/0254587 | A1 | 11/2007 | Schadler et al. | |
| 2009/0179814 | A1 | 7/2009 | Park et al. | |
| 2011/0140975 | A1 | 6/2011 | Shietomi | |
| 2013/0328733 | A1 | 12/2013 | Gunnels | |
| 2014/0240188 | A1 | 8/2014 | Mamo et al. | |
| 2016/0064807 | A1 | 3/2016 | Reed et al. | |
| 2017/0062940 | A1 | 3/2017 | Cao | |
| 2018/0366817 | A1 | 12/2018 | Sung et al. | |
| 2021/0119339 | A1 | 4/2021 | Smith, Jr. et al. | |

FOREIGN PATENT DOCUMENTS

| | | | |
|---|---|---|---|
| CN | 105375104 | A | 3/2016 |
| CN | 106654529 | | 5/2017 |
| CN | 207233933 | | 4/2018 |
| CN | 108717992 | | 10/2018 |
| JP | H07176925 | A | 7/1995 |
| JP | H11231037 | A | 8/1999 |
| KR | 20130112518 | | 10/2013 |
| WO | WO 2016/090463 | | 6/2016 |
| WO | WO 2016/187701 | | 12/2016 |
| WO | WO 2017/020114 | | 2/2017 |
| WO | WO 2017/133849 | | 8/2017 |
| WO | WO 2017/185184 | | 11/2017 |
| WO | WO 2018/074099 | | 4/2018 |

OTHER PUBLICATIONS

Griffiths, Lance, "A Fundamental and Technical Review of Radomes," MFG Galileo Composites, May 2008, in 4 pgs.

Kulkarni, Vishakha A., et al., "Performance Measurement of Polarization Diversity Printed Dipole Antenna Using High Frequency Pin Diode for WLAN", International Journal of Advanced Research in Electrical, Electronics and Instrumentation Engineering, vol. 2, Issue 5, May 2013; pp. 1917-1923; total of 7 pages.

Saenz, Elena, et al., "Coupling Reduction Between Dipole Antenna Elements by Using a Planar Meta-Surface," IEEE Transactions on Antennas and Propagation, vol. 57, No. 2, Feb. 2009, pp. 383-394, total of 13 pages.

Thompson, Rob, :Radomes: Do they Matter?, Powerpoint Presentation retrieved on Jun. 4, 2020 in 17 pgs.

* cited by examiner

MOBILE MULTI-FREQUENCY RF ANTENNA ARRAY WITH ELEVATED GPS DEVICES, SYSTEMS, AND METHODS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This invention relates to the field of wireless signals and communications, including, for example, wireless vehicular tracking and wireless vehicular communication. The present disclosure relates to novel designs, configurations, and arrangements of antenna systems and components that are specially adapted for improved tracking and communications for enhanced radio frequency (RF) communications and signals transmitted and/or received by the antenna systems and components.

Description of the Related Art

Electronic devices are used by billions of people around the world. Many of these devices are capable of wireless communication. Many of such communications occur over radio frequencies (RF) and, thus, utilize RF communications. RF communications may occur at various frequencies, from frequencies in the low kilohertz (kHz) range to the megahertz (MHz) or gigahertz (GHz) ranges. For example, RF communications can occur within a frequency range from 100 MHz to 85 GHz in certain applications. The FCC publishes descriptions of RF band allocations for the United States.

GPS is the Global Positioning System, an assortment of satellites that communicate with GPS receivers to triangulate a location on Earth. The acronym GPS originally referred to the US-based system for global positioning. Other countries have now fielded similar technologies which sometimes use other acronyms. Global Navigation Satellite Systems (GNSS) is the standard generic term for radio-navigation-satellite systems that provide autonomous geospatial positioning with global coverage. As used herein, GPS may refer to any and/or all of these global location systems. The US GPS system uses at least the following frequencies: L1 at 1575.42 MHz, L2 at 1227.6 MHz, and L5 at 1176.45 MHz.

A mobile phone, cellular phone, cell phone, cellphone or hand phone, sometimes shortened to simply mobile, cell, or phone, is a portable telephone that can make and receive calls over a radio frequency link while the user is potentially moving within a telephone service area. The radio frequency link establishes a connection to the switching systems of a mobile phone operator, which provides access to the public switched telephone network (PSTN). Mobile telephone services may use a cellular network architecture and, therefore, mobile telephones may be called cellular telephones or cell phones, especially in North America.

The radio frequencies used by mobile phones may vary depending on the technology version, provider, and/or the RF spectrum licensed for a particular use. A new generation of cellular standards has appeared approximately every ten years since 1G systems were introduced around 1980.

Each generation is typically characterized by new frequency bands, higher data rates and non—backward-compatible transmission technology. 3G (short for third generation) is the third generation of wireless mobile telecommunications technology. The first commercial 3G networks were introduced in 2001. 4G is the fourth generation of broadband cellular network technology, succeeding 3G.

Long-Term Evolution (LTE) is a standard for wireless broadband communication for mobile devices and data terminals, based on the GSM/EDGE and UMTS/HSPA technologies. LTE may be an upgrade path for carriers with both GSM/UMTS networks and CDMA2000 networks. The different LTE frequencies and bands used in different countries mean that only multi-band phones are able to use LTE in all countries where it is supported.

LTE is sometimes known as 3.95G and has been marketed both as "4G LTE" and as "Advanced 4G." The first-release Long Term Evolution (LTE) standard was commercially deployed in Oslo, Norway, and Stockholm, Sweden in 1998, and has since been deployed throughout most parts of the world.

5G is the fifth generation technology standard for cellular networks, which cellular phone companies began deploying worldwide in 2019. 5G wireless devices in a cell are connected to the Internet and telephone network by radio waves through a local antenna in the cell. The new networks may have greater bandwidth, giving higher download speeds. Due to the increased bandwidth, it is expected that the new networks will serve more than just cellphones but may also be used as general internet service providers for laptops and desktop computers. Such uses of 5G may compete with existing ISPs such as cable internet, and may also make possible new applications in internet of things (IoT) and machine to machine areas. Current 4G cellphones will not be able to use the new networks, which will require new 5G enabled wireless devices.

The increased speed of 5G is achieved partly by using higher-frequency radio waves than current cellular networks. However, higher-frequency radio waves have a shorter range than the frequencies used by previous cell phone towers, requiring smaller cells. So to ensure wide service, 5G networks may operate on multiple frequency bands each requiring different antennas.

Low-band 5G uses a similar frequency range to 4G cellphones, 600-700 MHz, giving download speeds a little higher than 4G: 30-250 megabits per second (Mbit/s). Low-band cell towers will have a similar, though potentially larger, range and coverage area to current 4G towers. Mid-band 5G uses microwaves of 2.5-3.7 GHz, currently allowing speeds of 100-900 Mbit/s, with each cell tower providing service up to several miles in radius. High-band 5G may use frequencies of 25-39 GHz, near the bottom of the millimeter wave band, although higher frequencies may alternately be used. 5G often achieves download speeds of a gigabit per second (Gbit/s); speeds comparable to terrestrial wired internet connections. However, millimeter waves (mmWave or mmW) have a more limited range, requiring many small cells, and have trouble passing through some types of walls and windows.

WiMAX (Worldwide Interoperability for Microwave Access) is a family of wireless broadband communication standards based on the IEEE 802.16 set of standards. The WiMAX Forum describes WiMAX as "a standards-based technology enabling the delivery of last mile wireless broadband access as an alternative to cable and DSL." WiMAX release 2.1, popularly branded as/known as WiMAX 2+, is a backwards-compatible transition from previous WiMAX generations. It is compatible and interoperable with TD-LTE.

Wi-Fi is a family of wireless network protocols, based on the IEEE 802.11 family of standards, which are commonly used for local area networking of devices and Internet access. The different versions of Wi-Fi are specified by various IEEE 802.11 protocol standards, with the different radio technologies determining radio bands, and the maximum ranges and speeds that may be achieved. Wi-Fi most commonly uses the 2.4 GHz (125 mm wavelength) and 5 GHz (60 mm wavelength) SHF ISM radio bands; these bands are subdivided into multiple channels. Wi-Fi's wavebands have relatively high absorption and work best for line-of-sight use.

An antenna is the interface between radio waves propagating through space and electric currents moving in metal conductors, used with a transmitter, receiver, or a transceiver. In transmission, a radio transmitter supplies an electric current to the antenna's terminals, and the antenna radiates the energy from the current as electromagnetic waves (radio waves, radio frequency (RF) waves, electronic signals, or other comparable term). In reception, an antenna intercepts some of the power of a radio wave to produce an electric current at its terminals. An antenna transmits at the same frequency at which it would best receive signals. Therefore, the use of the terms transmitter, receiver, or transceiver are interchangeable terms for the appropriate direction of signal propagation and an antenna may be used for either/all of transmit or receive unless otherwise specified. Antennas are useful components of radio equipment.

An antenna is an array of conductors, electrically connected to a receiver or transmitter. Antennas can be designed to transmit and/or receive radio waves in horizontal directions (parallel to the horizon) equally (omnidirectional antennas), preferentially in a particular direction (directional, or high-gain, or "narrow beamwidth" antennas), or in some other pattern. In some applications, the construction and/or arrangement of the antenna does not adequately transmit and/or receive radio waves as desired.

SUMMARY OF THE INVENTION

According to some aspects of the present disclosure, the recognition of certain deficiencies in prior antenna systems forms part of the basis for the inventive development of the improved solutions in the present subject matter. Improved wireless signals and communications, including, in particular wireless vehicular tracking and wireless vehicular communication can be improved with a novel multi-frequency antenna array system. The system can include multiple antenna components with a novel arrangement to achieve improved performance. One aspect involves the elevation of the GPS antenna to an elevated plane for improved transmissions. Other aspects involve improved structural support and spacing through unique arrangements of PCB antennas appropriately spaced and protected. The present disclosure relates to novel designs, configurations, and arrangements of antenna systems and components that are specially adapted for improved tracking and communications for enhanced radio frequency (RF) communications and signals transmitted and/or received by the antenna systems and components.

Different communication systems may have different preferred directional patterns. Terrestrial mobile communication systems tend to have transmitters and receivers in the same horizontal plane but often without a preferred direction in that plane. Terrestrial mobile communication may include 1G, 3G, 4G, LTE, 5G, WiMax, WiFi, or other similar RF communication system. Satellite communication interacts between a ground based device and an orbiting satellite. The directional pattern for satellite communication is typically the upper hemisphere, ranging from anywhere along the horizontal plane through directly vertical. Satellite communications may include GPS, GNSS, satellite phones, or other satellite based communication. Fixed directional communication are common between a fixed transmitter and receiver and both transmission and reception may be improved using directional antennas. Fixed directional communications may mix the use of omnidirectional and directional antennas. TV and radio broadcasts are an example that may employ an omnidirectional transmitter and directional receiving antennas. Other uses of directional communications may include point to point microwave communication links or other types of communication. Fixed direction communication may involve directional antennas that change direction yet maintain their relative orientation between the directional antenna(s) of the transmitter and/or receiver.

An antenna may work at a frequency, or range of frequencies. In situations requiring communication using diverse frequencies not adequately served by a single antenna, multiple antennas may be combined in an array. Such a multi-band array may, or may not, be designed to account for the interaction between the multiple antennas.

Multi-band antenna arrays incorporating high-precision GPS elements require a clear view of the sky in order to achieve optimal performance for the GPS element, especially in certain extreme latitudes. Existing designs locate the GPS element on the array's groundplane at the base of other antenna elements. In highly compact multiband antenna arrays, the surrounding elements shadow the GPS element's reception from the satellites that are used for location triangulation. This shadowing causes multipath in the received signals from the satellites and can diminish signal strength or disturb the timing, thereby affecting location accuracy. To achieve greater accuracy in the location of the device, the GPS element requires a clear line-of-sight to the horizon in order to receive as many satellite signals as possible. Shadowing in some systems could be reduced by increasing the diameter of the groundplane of the communication array, thereby creating more space between antennas. However, this larger size is not always a desirable option in view of other design constraints. Accordingly, in some cases a larger size can be an unsatisfactory work around for mounting the GPS antenna to the bottom of the assembly.

Antennas are typically designed individually, based on the requirements of the frequency and application they are to be used for. However, when multiple antennas are near each other they may interfere or degrade one another's performance.

Frequently antenna arrays incorporate off-the-shelf components that are often combined in an ad-hoc way. Individual antennas that need to be combined for a particular application may be combined in a device without regard to the interplay between the antennas with one another and may be attached to a baseplate, or other structure, in order to combine the multiple antennas into an array.

The ad-hoc nature of modeling antenna deployments means that many antennas are assembled by those inexperienced in the technical workings of antennas. These inexperienced workers are therefore constrained by the instructions and guidelines provided by the individual makers of antennas. GPS manufacturers recommend that GPS antennas be attached to the baseplate. Alternate implementations are not recommended without testing and validation which drive up costs.

Multi-antenna arrays have a base cost defined by the included component antennas. Combining those antennas into a single structure merges the component costs to create that combined structure but potentially lowers the installation cost which can be substantial.

Installation costs for an antenna array can be a substantial component. Installing multiple individual antennas on top of a vehicle creates numerous pathways, cabling and arrangement requirements to accomplish the goals of the numerous antennas. Creating an ad-hoc combination of antennas as a multi-antenna array may decrease the installation costs on a vehicle but is difficult to evaluate or modify in advance based on the off-the-shelf nature of the components and the generally low technical ability of those assembling the components.

Placing a GPS antenna on its own groundplane typically drives up costs in contrast to reusing an existing groundplane used by other antennas in an array. Antenna manufacturers often recommend an aluminum baseplate or other conductor to use as a groundplane for the antenna.

Placing a GPS antenna on its own aluminum plate as a groundplane is expensive. Combining such a metal-mounted antenna with other antennas as part of an array is difficult to structurally stabilize.

Cables and connectors in multi-antenna arrays are subject to degradation over time. Attaching multiple antennas to a baseplate may allow those antennas to flex, warping the connections and potentially degrading the conductors.

According to some preferred embodiments, greater accuracy in the location of the vehicle can be achieved when the GPS element has a more clear line-of-sight to the horizon in order to receive as many satellite signals as possible. This can be achieved in some embodiments by elevating the GPS element and it's groundplane above all the other antenna elements in the communication array. This also reduces the amount of coupling between the GPS element and the communication array which further improves the accuracy of the GPS and therefore improves accuracy in the perceived location of the vehicle. Another advantage of raising the GPS element and its groundplane above the communication elements is that the performance of all the antenna elements in the array may improve as well.

Elevating the GPS element above the surrounding elements effectively eliminates this interference and provides a technical advantage. Some embodiments elevate the GPS element onto an elevated PCB, which contains its own integrated groundplane and may also serves as a mechanical structure to lock all the elements in place. Existing solutions mount the GPS on the baseplate and use the baseplate for the groundplane of the GPS antenna.

According to some embodiments, a mobile antenna array system for radio frequency communication comprises a first baseplate in a first plane defining a first groundplane. An elevated second baseplate is in a second plane generally parallel to the first plane and spaced a fixed distance above the first plane in use. The elevated second baseplate defines an elevated second groundplane. The elevated second baseplate comprises a printed circuit board with a plurality of openings defined along a periphery of the printed circuit board.

A plurality of support antennas are positioned between the first baseplate and the elevated second baseplate. The plurality of support antennas each comprise a printed circuit board. The plurality of support antennas comprise a first pair of antennas configured to work within a first range of frequencies, a second pair of antennas configured to work within a second range of frequencies different from the first range of frequencies, a third pair of antennas configured to work within a third range of frequencies different from the first and second range of frequencies, and a fourth pair of antennas configured to work within a fourth range of frequencies different from the first, second, and third range of frequencies. The plurality of support antennas have respective base portions coupled to the first baseplate and respective upper portions coupled to the elevated second baseplate. The respective upper portions comprise extensions shaped to fit into the openings defined along the periphery of the printed circuit board of the elevated second baseplate.

An elevated GPS antenna is positioned above the elevated second baseplate in use. The elevated GPS antenna is configured to work within a GPS range of frequencies different from the support antenna ranges of frequencies. The elevated GPS antenna has a base portion coupled to the elevated second baseplate.

In some embodiments of the system, the first pair of antennas are broad band LTE antennas, the second pair of antennas are single band LTE antennas, the third pair of antennas are WiFi antennas, and the fourth pair of antennas are 900 MHz ISM antennas. The pairs of antennas are positioned opposite one another along the periphery of the first baseplate in use. In some embodiments, the system includes a vehicle coupled to the first baseplate.

According to some embodiments, a mobile antenna array system comprises a first baseplate in a first plane defining a first groundplane. An elevated second baseplate in a second plane is generally parallel to the first plane and spaced a fixed distance above the first plane in use. The elevated second baseplate defines an elevated second groundplane. A plurality of support antennas are positioned between the first baseplate and the elevated second baseplate. The plurality of support antennas comprise at least a first antenna configured to work within a first range of frequencies and a second antenna configured to work within a second range of frequencies different from the first range of frequencies. The first and second antennas have respective base portions coupled to the first baseplate. An elevated GPS antenna is positioned above the elevated second baseplate in use. The elevated GPS antenna is configured to work within a GPS range of frequencies different from the support antenna ranges of frequencies. The elevated GPS antenna has a base portion coupled to the elevated second baseplate.

In some embodiments, the elevated second baseplate comprises a printed circuit board. The first and second antennas comprise respective printed circuit boards. The first and second antennas have respective upper portions mechanically coupled to the elevated second baseplate. Each of the first and second antennas includes at least one of a broad band LTE antenna, a single band LTE antenna, a WiFi antenna, and a 900 MHz ISM antenna.

In some embodiments, the plurality of support antennas comprises a broad band LTE antenna, a single band LTE antenna, a WiFi antenna, and a 900 MHz ISM antenna. The plurality of support antennas in some embodiments comprises a pair of broad band LTE antennas, a pair of single band LTE antennas, a pair of WiFi antennas, and a pair of 900 MHz ISM antennas.

In some embodiments, the plurality of support antennas comprises at least a third antenna configured to work within the first range of frequencies of the first antenna, and comprises at least a fourth antenna configured to work within the second range of frequencies of the second antenna. The first antenna is positioned opposite the third antenna along a periphery of the first baseplate in use, and the second antenna is positioned opposite the fourth antenna along the periphery of the first baseplate in use.

In some embodiments the elevated second baseplate defines at least one opening, and at least one of the plurality of support antennas comprises an extension shaped to fit into the opening in the baseplate. In some embodiments the system comprises a vehicle coupled to the first baseplate and/or other features or components of the antenna array system.

According to some aspects of the disclosure, a method of manufacturing a mobile antenna array system comprises providing a first baseplate in a first plane defining a first groundplane. An elevated second baseplate is provided in a second plane generally parallel to the first plane and spaced a fixed distance above the first plane in use, the elevated second baseplate defining an elevated second groundplane. A plurality of support antennas are positioned between the first baseplate and the elevated second baseplate, the plurality of support antennas comprising at least a first antenna configured to work within a first range of frequencies and a second antenna configured to work within a second range of frequencies different from the first range of frequencies. Base portions of first and second antennas are coupled to the first baseplate. Upper portions of first and second antennas are coupled to the elevated second baseplate. A GPS antenna is coupled above the elevated second baseplate for GPS in use. The elevated GPS antenna is configured to work within a GPS range of frequencies different from the support antenna ranges of frequencies. In some embodiments, each of the first and second antennas includes at least one of a broad band LTE antenna, a single band LTE antenna, a WiFi antenna, and a 900 MHz ISM antenna. The first baseplate is coupled to a vehicle in some embodiments.

According to some aspects of the disclosure, a method of using a mobile antenna array system comprises transmitting or receiving RF signals to or from a first antenna of a mobile antenna array system within a first frequency range. The first antenna is mounted between a first baseplate positioned within a first plane defining a first groundplane and an elevated second baseplate in a second plane generally parallel to the first plane and spaced a fixed distance above the first plane in use, the elevated second baseplate defining an elevated second groundplane. The method also includes transmitting or receiving RF signals to or from a second antenna of the mobile antenna array system within a second frequency range different from the first frequency range, the second antenna being mounted between the first baseplate and the elevated second baseplate. The method also includes transmitting or receiving RF signals to or from a GPS antenna of the mobile antenna array system within a GPS frequency range different from the first and second frequency ranges, the GPS antenna being mounted above the elevated second baseplate. In some aspects, transmitting or receiving RF signals to or from one or more of the first antenna, the second antenna, and the GPS antenna is performed while the mobile antenna array system is coupled to a vehicle in motion. GPS satellites have bidirectional communications capabilities. However, these are done at different frequency bands than the bands used for geo-location services. Geolocation focused functionality is usually receive only and does not require transmission. Since antennas transmit and receive the same way, based on the physics of how antennas work, any discussion of radiation characteristics applies to either/both transmitting or receiving.

BRIEF DESCRIPTION OF THE DRAWINGS

Features illustrated in the drawings may not be drawn to scale. Dimensions of the various features may be shown expanded or reduced for clarity in some cases. Additionally, some of the drawings may not depict all of the features, aspects, or components of a particular system, method or device.

DETAILED DESCRIPTION

Figure 1:
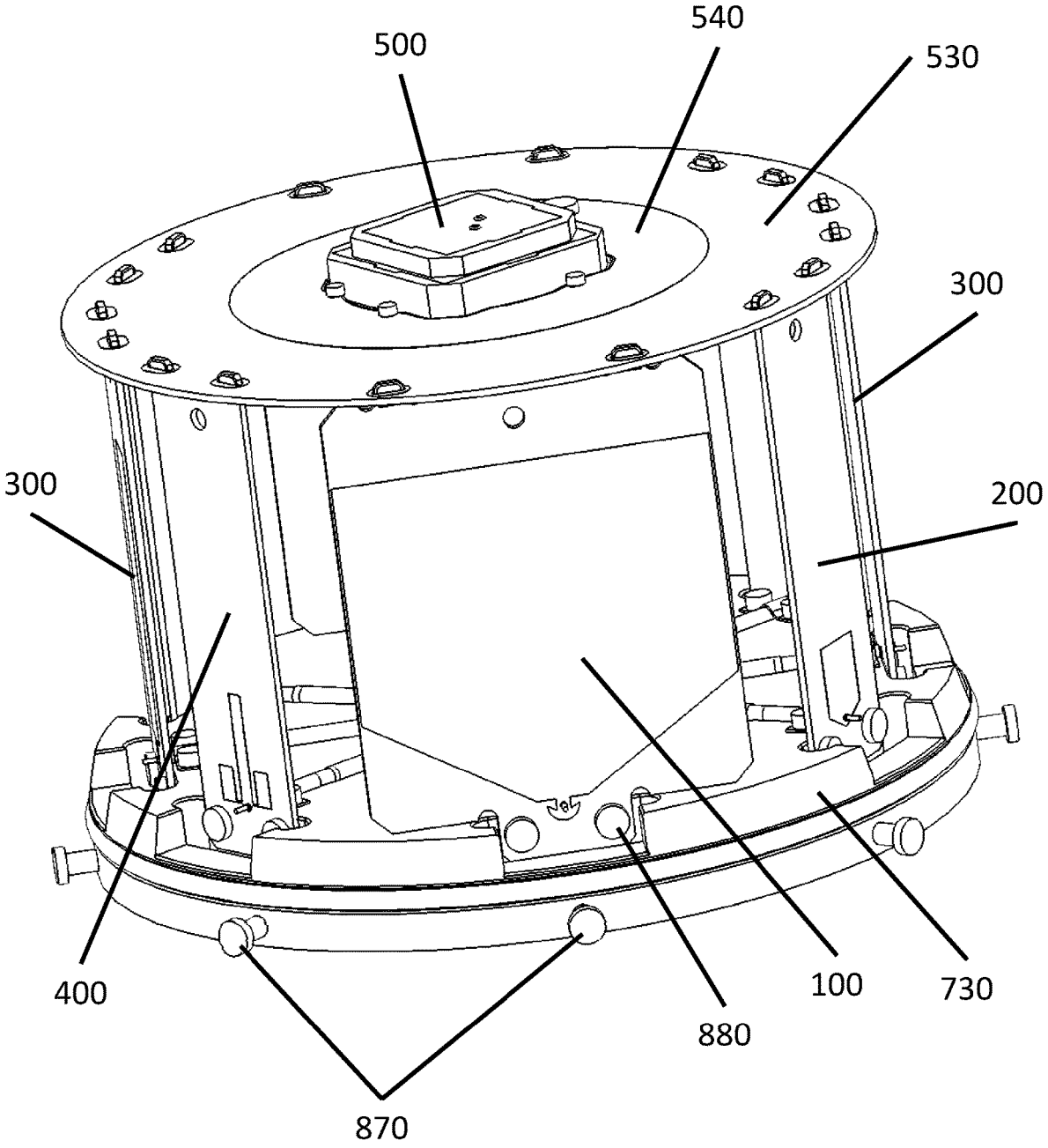
FIG. 1 is a perspective view of an antenna array without a radome according to some embodiments.

This present disclosure relates to the field of wireless signals and communications, including, for example, wireless vehicular tracking and wireless vehicular communication. Improved antenna communication devices, systems and methods can include multiple antenna components with novel arrangements to achieve improved performance. One aspect involves the elevation of the GPS antenna to an elevated groundplane for improved transmissions. Other aspects involve improved structural support and spacing through unique arrangements of PCB antennas appropriately spaced and protected. The present disclosure relates to novel designs, configurations, and arrangements of antenna systems and components that are specially adapted for improved tracking and communications for enhanced radio frequency (RF) communications and signals transmitted and/or received by the antenna systems and components.

For example, according to some embodiments, a mobile antenna array system suitable for use in vehicular applications, or other mobile applications, has a first baseplate with a first groundplane. An elevated second baseplate defines an elevated second groundplane. A plurality of support antennas are positioned between the first baseplate and the elevated second baseplate. The plurality of support antennas comprise multiple antennas configured to work at different frequencies. The plurality of support antennas are coupled to the first and second baseplates in mechanical connections that provide enhanced stability, tight tolerances, repeatability and low cost through the use of printed circuit boards as substrates for one or more of the antennas and baseplates. An elevated GPS antenna is positioned above the elevated second baseplate in use. The elevated GPS antenna is configured to work within a GPS range of frequencies different from the support antenna ranges of frequencies. The elevated GPS antenna has improved GPS transmissions and the support antennas also have improved positioning and functionality due to locating the GPS antenna above the support antennas and second baseplate.

The following detailed description of certain embodiments presents various descriptions of specific embodiments. However, the innovations described herein can be embodied in a multitude of different ways, for example, as defined and covered by the claims. In this description, reference is made to the drawings where like reference numerals can indicate identical or functionally similar elements. Moreover, it will be understood that certain embodiments can include more elements than illustrated in a drawing and/or certain embodiments can include a subset of the elements illustrated in a drawing. Further, some embodiments can incorporate any suitable combination of features from two or more drawings.

According to some preferred embodiments, greater accuracy in the location of the vehicle can be achieved when the GPS element has a more clear line-of-sight to the horizon in order to receive as many satellite signals as possible. This can be achieved in some embodiments by elevating the GPS element and it's groundplane above all the other antenna elements in the communication array. This also reduces the amount of coupling between the GPS element and the communication array which further improves the accuracy of the GPS and therefore improves accuracy in the perceived location of the vehicle. Another advantage of raising the GPS element and its groundplane above the communication elements is that the performance of all the antenna elements in the array may improve as well.

Elevating the GPS element above the surrounding elements effectively eliminates this interference and provides a technical advantage. Some embodiments elevate the GPS element onto an elevated PCB, which contains its own integrated groundplane and may also serves as a mechanical structure to lock all the elements in place. Existing solutions mount the GPS on the baseplate and use the baseplate for the groundplane of the GPS antenna.

According to some embodiments, a mobile antenna array system for radio frequency communication comprises a first baseplate in a first plane corresponding to a first groundplane. An elevated second baseplate is in a second plane generally parallel to the first plane and spaced a fixed distance above the first plane in use. The elevated second baseplate corresponds to an elevated second groundplane. The elevated second baseplate comprises a printed circuit board with a plurality of openings defined along a periphery of the printed circuit board.

A plurality of support antennas are positioned between the first baseplate and the elevated second baseplate. The plurality of support antennas each comprise a printed circuit board. The plurality of support antennas comprise a first pair of antennas configured to work within a first range of frequencies, a second pair of antennas configured to work within a second range of frequencies different from the first range of frequencies, a third pair of antennas configured to work within a third range of frequencies different from the first and second range of frequencies, and a fourth pair of antennas configured to work within a fourth range of frequencies different from the first, second, and third range of frequencies. The plurality of support antennas have respective base portions coupled to the first baseplate and respective upper portions coupled to the elevated second baseplate. The respective upper portions comprise extensions shaped to fit into the openings defined along the periphery of the printed circuit board of the elevated second baseplate.

An elevated GPS antenna is positioned above the elevated second baseplate in use. The elevated GPS antenna is configured to work within a GPS range of frequencies different from the support antenna ranges of frequencies. The elevated GPS antenna has a base portion coupled to the elevated second baseplate.

In some embodiments of the system, the first pair of antennas are broad band LTE antennas, the second pair of antennas are single band LTE antennas, the third pair of antennas are WiFi antennas, and the fourth pair of antennas are 900 MHz ISM antennas. The pairs of antennas are positioned opposite one another along the periphery of the first baseplate in use. In some embodiments, the system includes a vehicle coupled to the first baseplate.

FIG. 1 is a perspective view of an antenna array without a radome according to some embodiments. As shown, an array baseplate 730 has eight antenna boards connected around its circumference. A broad band LTE antenna board 100 is the largest of these. A WiFi antenna board 400, a single band LTE antenna board 200, and a 900 MHz ISM antenna board 300 are shown in the figure. According to some embodiments, some antenna types may be duplicated for MiMo or for receive diversity applications. As shown in the figure, there are two of each type of PCB antenna in the illustrated embodiment. A GPS antenna assembly 500 is shown at the top of the array. Beneath the GPS antenna assembly 500 is a GPS groundplane 540. Each of these resides on top of a GPS substrate 530. Each antenna board, such as the broad band LTE antenna board 100, is shown with a pair of PCB fasteners 880 that affix the antenna board to the array baseplate 730. Around the peripheral edge of the array baseplate 730 are a number of radome fasteners 870 for securing a radome to the antenna array.

Figure 2:
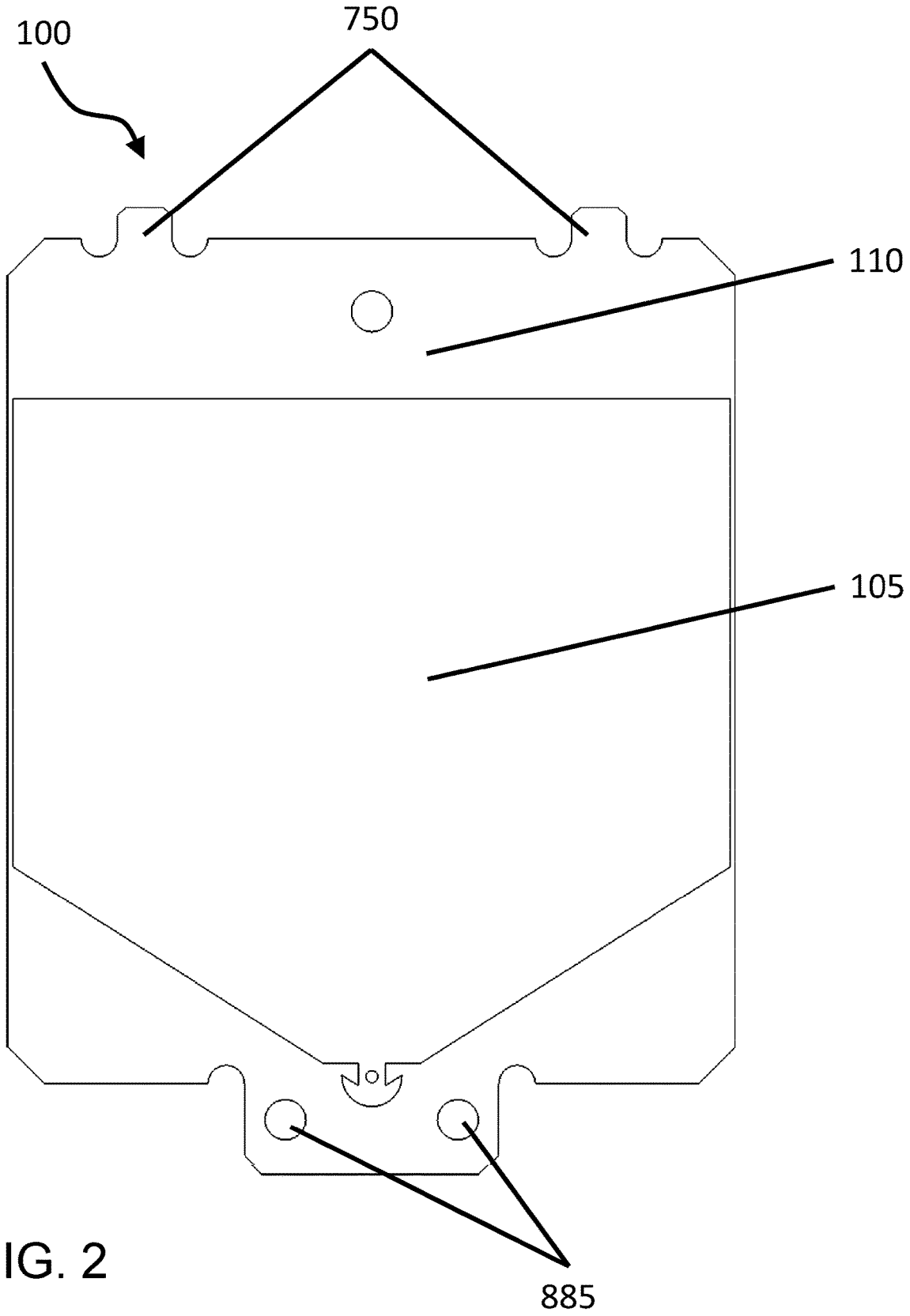
FIG. 2 is a view of a dual band LTE monopole antenna according to some embodiments.

FIG. 2 is a view of a broad band LTE antenna board 100 according to some embodiments. Two PCB attachment holes 885 may be used to secure the antenna to the array baseplate 730. The LTE antenna board 100 comprises an LTE substrate 110 and an LTE antenna 105. The LTE substrate 110 contains two protruding PCB fingers 750, or extensions, which may be inserted in a corresponding PCB notch 760 in another component (see FIG. 11A, 11B), such as, for example, the GPS baseplate 530.

Figure 3:
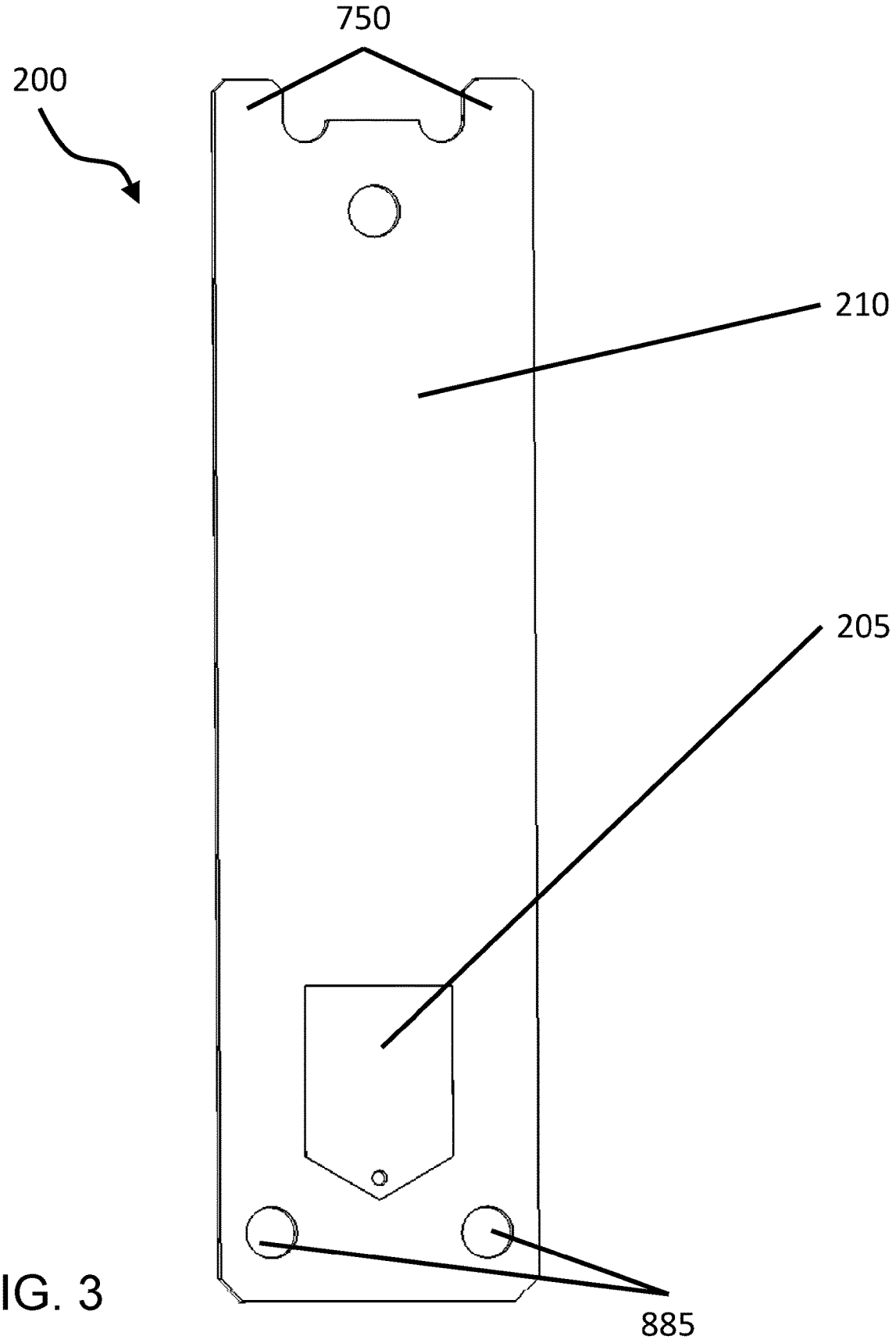
FIG. 3 is a view of a high band LTE antenna according to some embodiments.

FIG. 3 is a view of a single band LTE antenna board 200 according to some embodiments. As shown in FIG. 3, the single band LTE antenna 200 board has a LTE PCB 210 with two PCB attachment holes 885 to allow the LTE PCB 210 to be secured to an array baseplate. The LTE PCB 210 contains a LTE antenna 205 etched to the PCB. The LTE PCB 210 and LTE antenna 205 defines an opening within the antenna 205 to receive a pin of a coaxial cable to provide the electrical connection to drive the antenna signal for this antenna. The single band LTE antenna PCB 210 contains two protruding PCB fingers 750, or extensions, which may be inserted in a corresponding PCB notch 760 in another component, such as, for example, the GPS baseplate 530.

Figure 4:
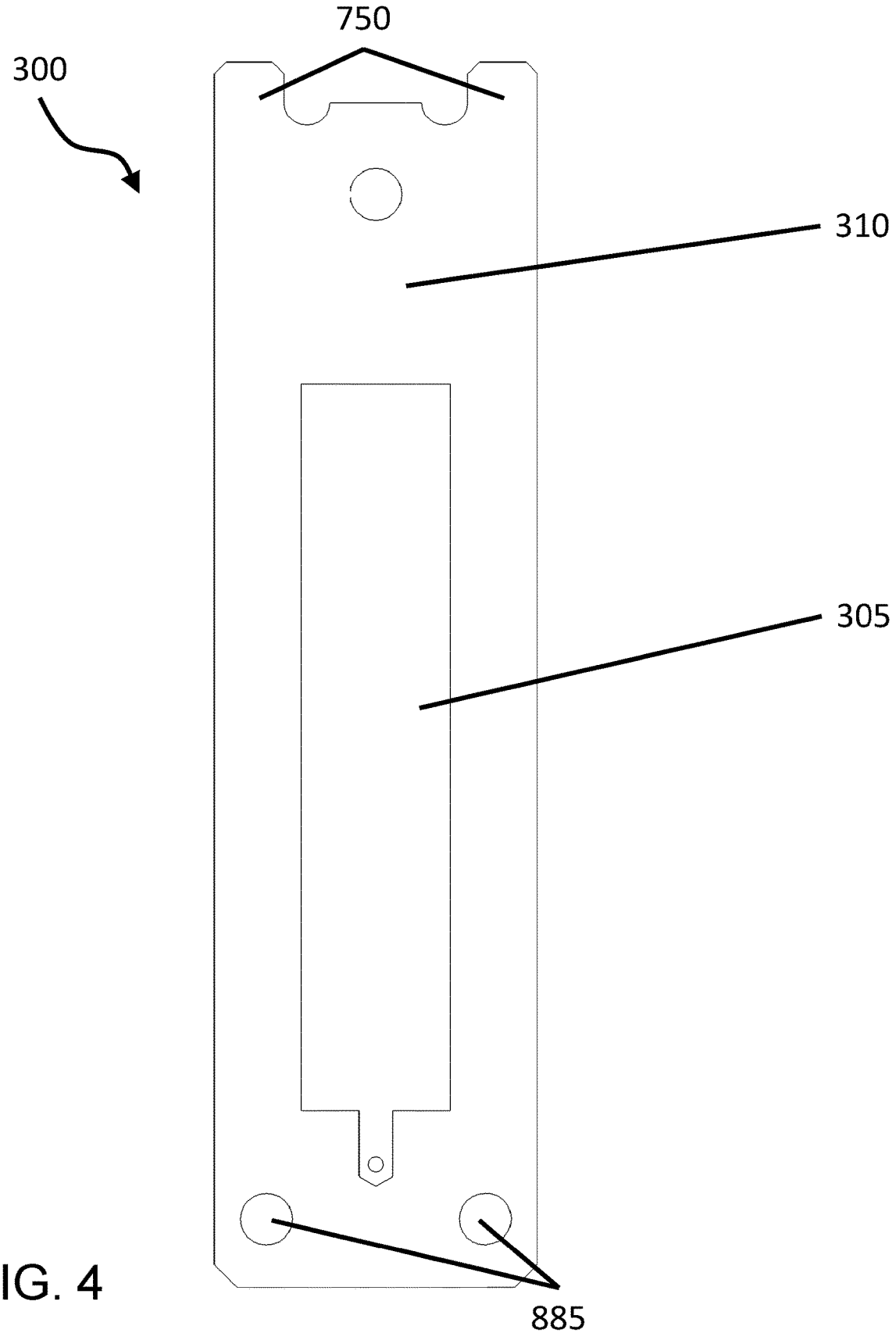
FIG. 4 is a view of a 900 MHz ISM band antenna according to some embodiments.

FIG. 4 is a view of a 900 MHz ISM band antenna board 300 according to some embodiments. As shown in FIG. 4, the 900 MHz ISM band antenna board 300 has a PCB 310 with two PCB attachment holes 885 to allow the PCB 310 to be secured to an array baseplate. The PCB 310 contains an antenna 305 etched to the PCB. The PCB 310 and antenna 305 defines an opening within the antenna 305 to receive a pin of a coaxial cable to provide the electrical connection to drive the antenna signal for this antenna. The 900 MHz ISM band antenna PCB 310 contains two protruding PCB fingers 750, or extensions, which may be inserted in a corresponding PCB notch 760 in another component, such as, for example, the GPS baseplate 530.

Figure 5:
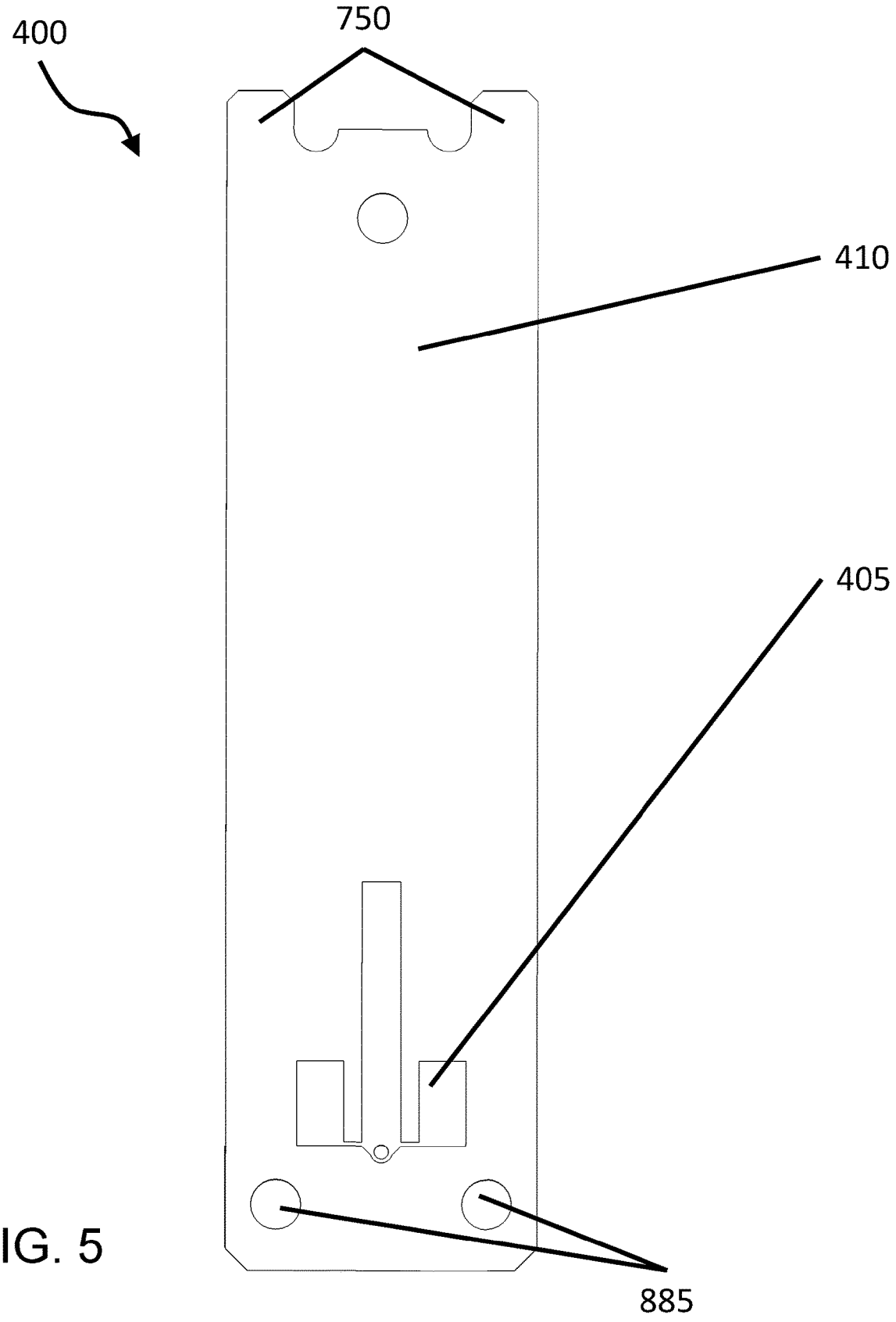
FIG. 5 is a view of a dual band WiFi antenna according to some embodiments.

FIG. 5 is a view of a dual band WiFi antenna board 400 according to some embodiments. As shown in FIG. 5, the dual band WiFi antenna board 400 has a WiFi PCB 410 with two PCB attachment holes 885 to allow the WiFi PCB 410 to be secured to an array baseplate. The WiFi PCB 410 contains a WiFi antenna 405 etched to the PCB 410. The WiFi PCB 410 and WiFi antenna 405 define an opening within the antenna 405 to receive a pin of a coaxial cable to provide the electrical connection to drive the antenna signal for this antenna. The dual band WIFI antenna PCB 410 contains two protruding PCB fingers 750, or extensions, which may be inserted in a corresponding PCB notch 760 in another component, such as, for example, the GPS baseplate 530.

Figure 6:
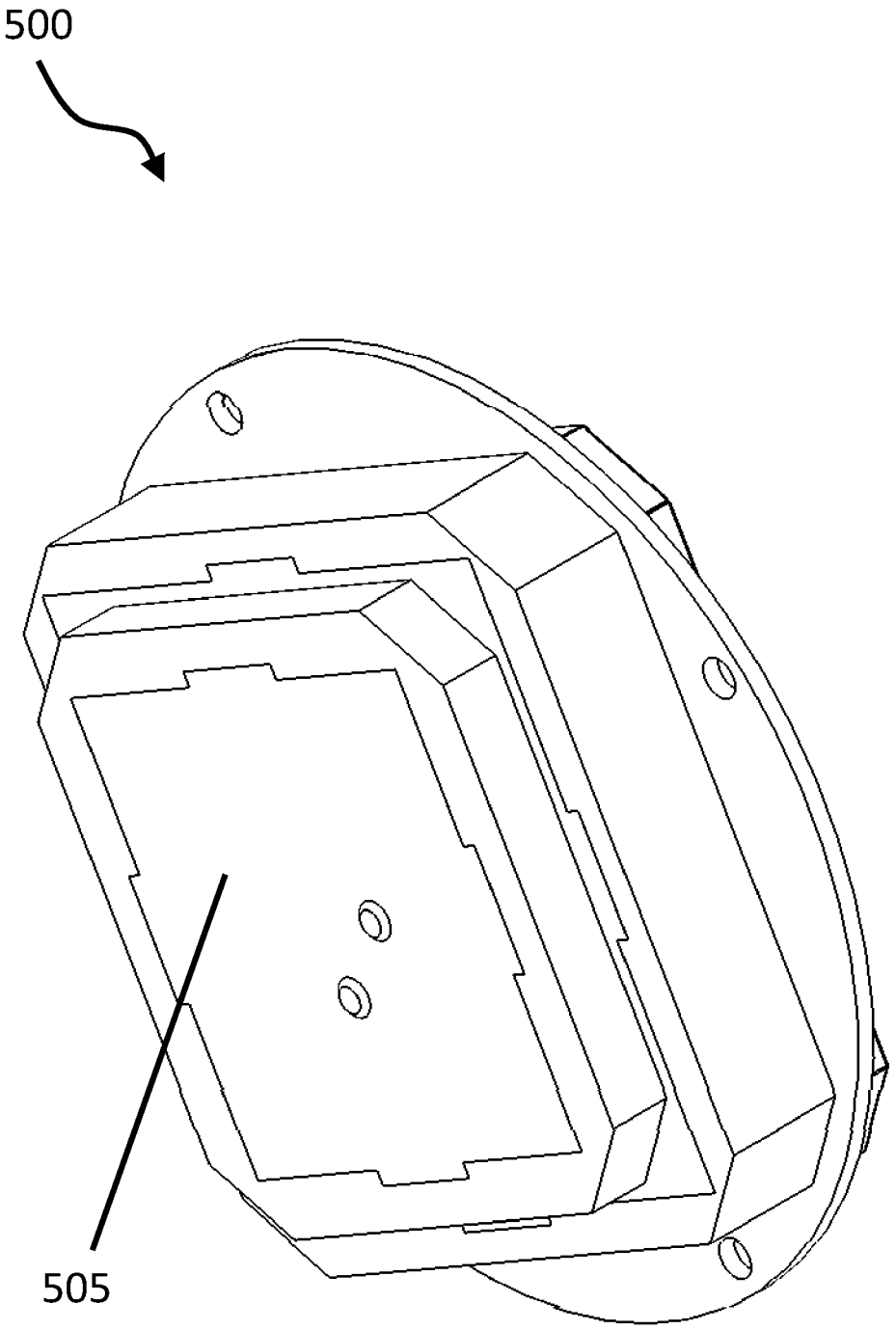
FIG. 6 is a perspective view of a GPS antenna according to some embodiments.

FIG. 6 is a perspective view of a GPS antenna assembly 500 according to some embodiments. The GPS antenna 505 is part of the GPS antenna assembly 500.

Figure 7:
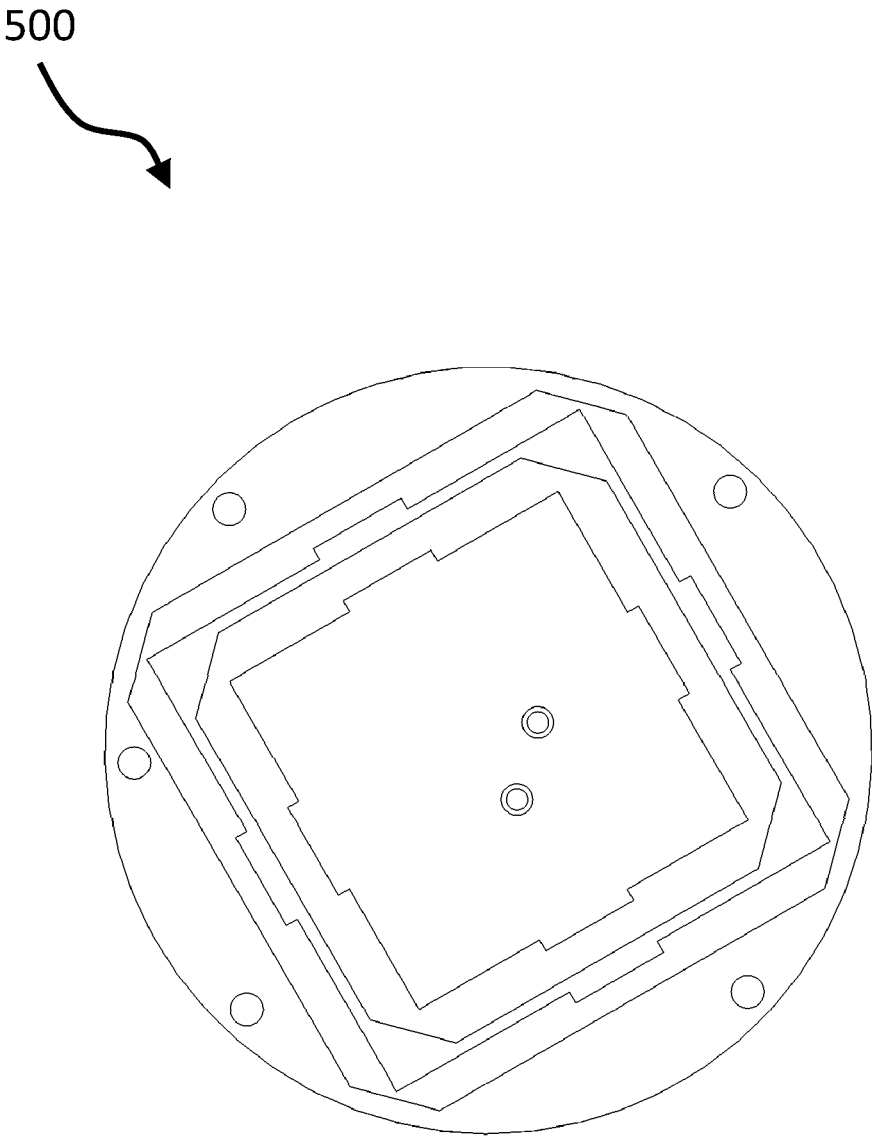
FIG. 7 is a top view of a GPS antenna according to some embodiments.

FIG. 7 is a top view of a GPS antenna according to some embodiments.

Figure 8:
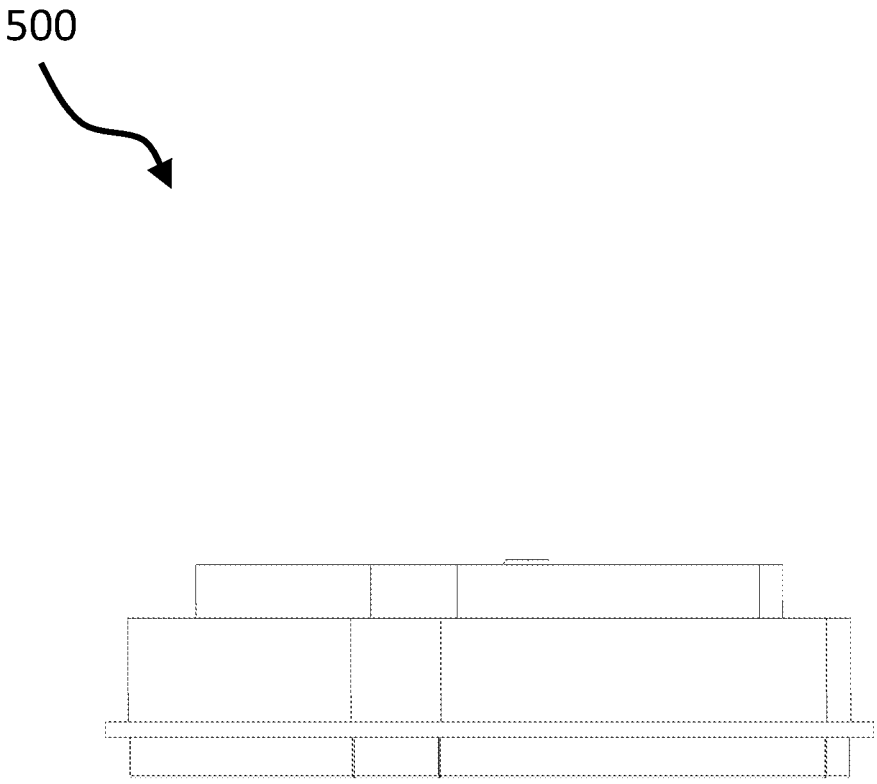
FIG. 8 is a side view of a GPS antenna according to some embodiments.

FIG. 8 is a side view of a GPS antenna according to some embodiments.

Figure 9:
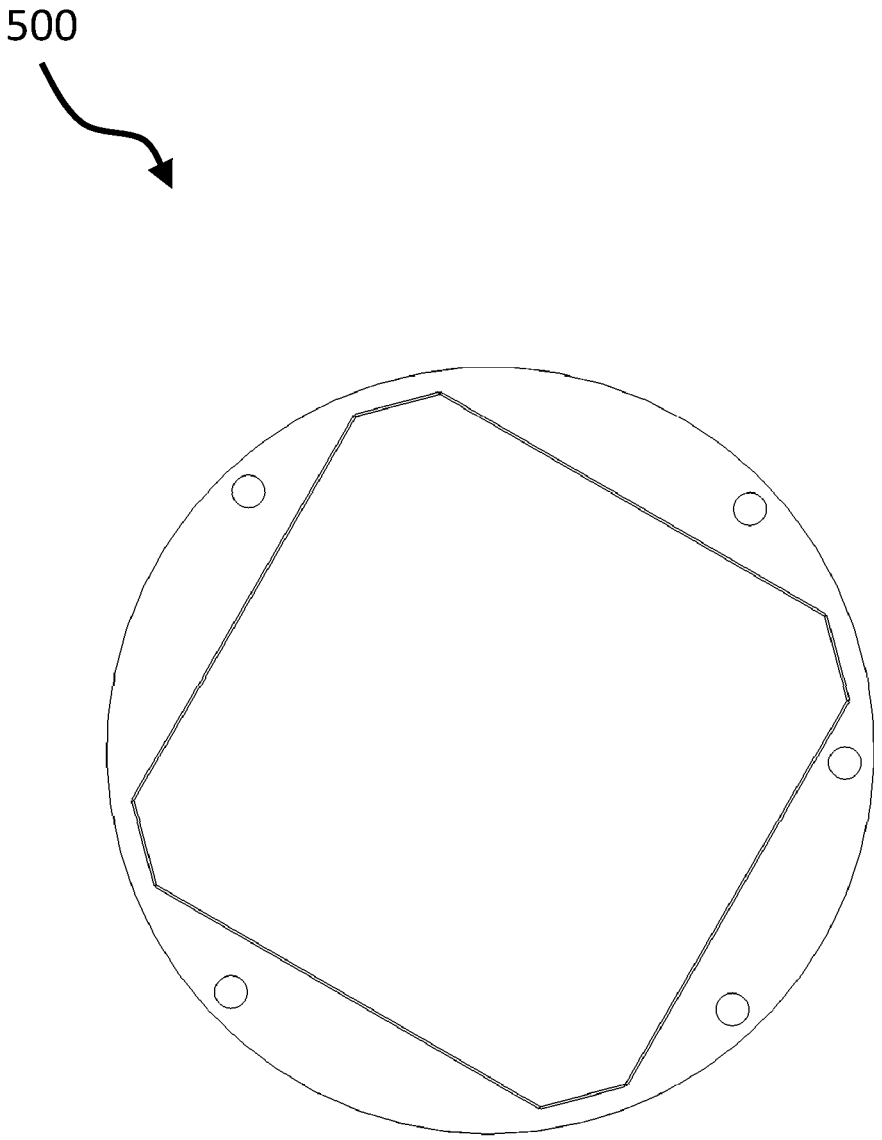
FIG. 9 is a bottom view of a GPS antenna according to some embodiments.

FIG. 9 is a bottom view of a GPS antenna according to some embodiments.

Figure 10:
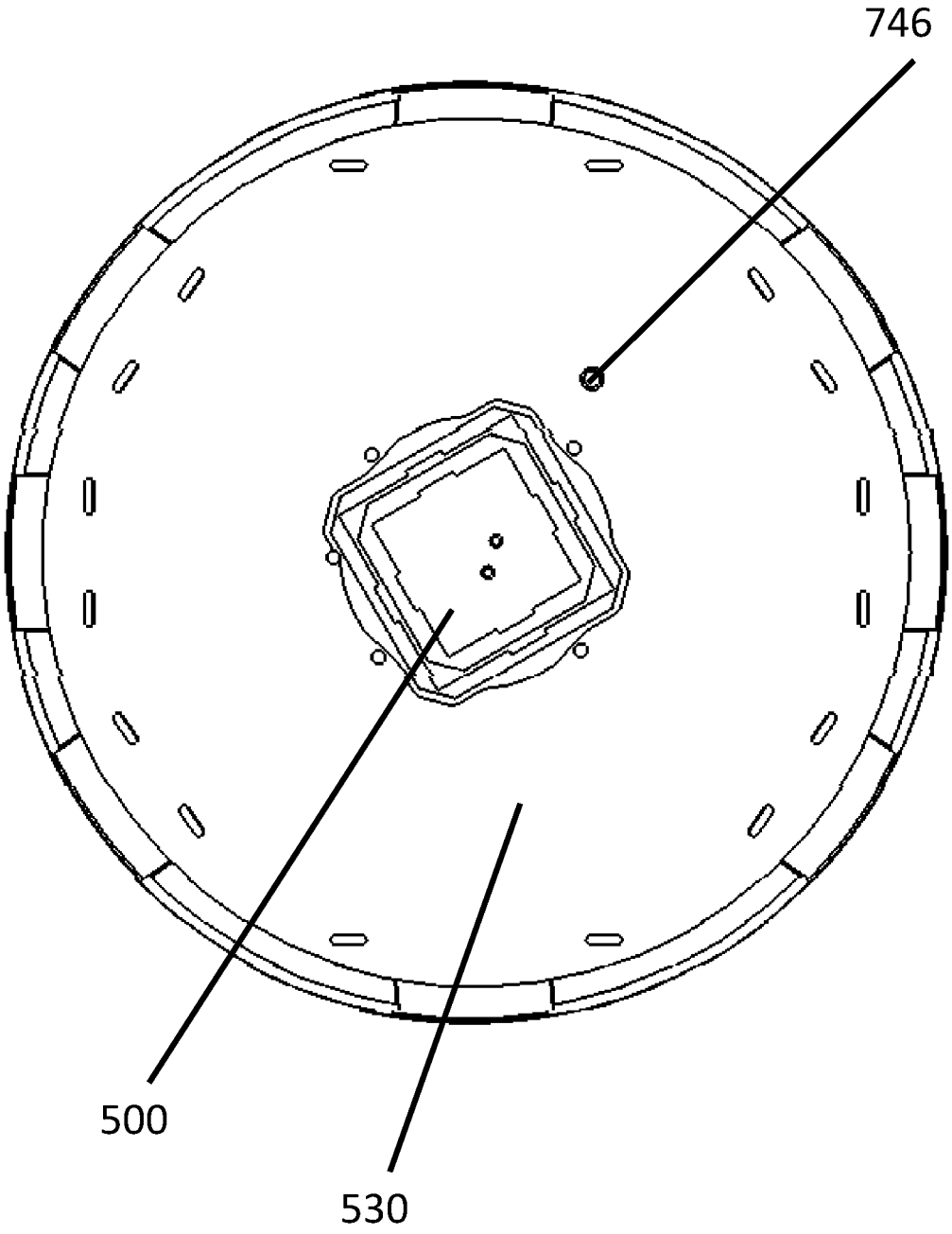
FIG. 10 is a top view of an antenna array according to some embodiments.

FIG. 10 is a top view of an antenna array according to some embodiments. A GPS antenna assembly 500 is visible in the center of the GPS support structure 520. A post attachment opening 746 is defined in the GPS antenna baseplate 530 through which a screw, or other fastener, may attach to an underlying post 740 providing structural support and stability to connect to the antenna array baseplate 730 below.

For each of the structural features disclosed other forms of mechanical connections can alternatively be used. The number of connections can vary, the style can vary, the arrangement of the components on the baseplate 730 can vary, and other variations are possible. The layout shown in the illustrated embodiments uses the natural symmetry of a circular array baseplate 730 and places pairs of antennas around the circumference to maximize the distance between antennas. Maximizing the distance between antennas minimizes the mutual coupling between them. In situations where a circular layout would be undesirable, a rectangular layout, or other geometric arrangement, could be used.

Figure 11A:
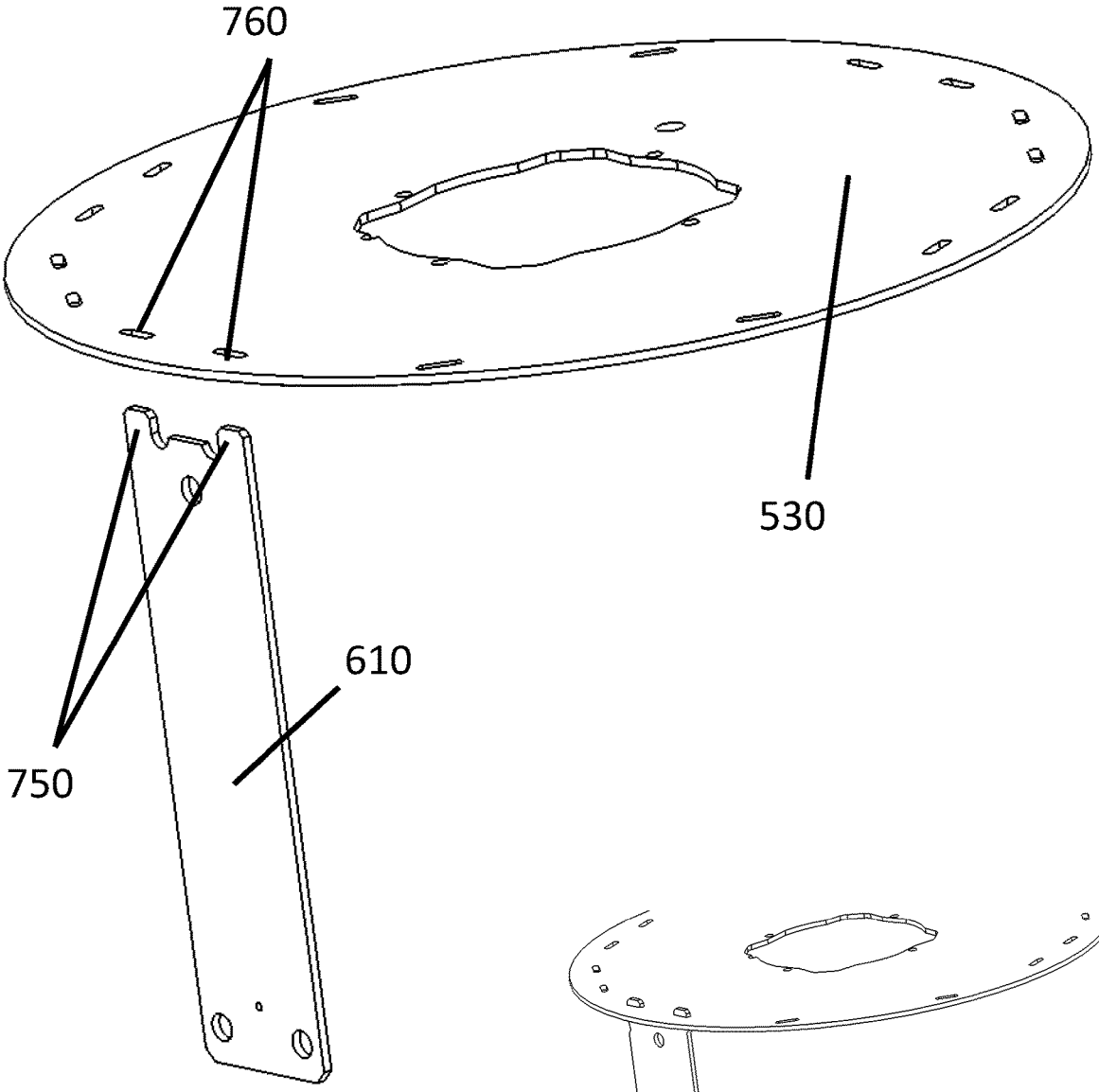
FIG. 11A is a view of an antenna PCB board and an elevated baseplate.
Figure 11B:
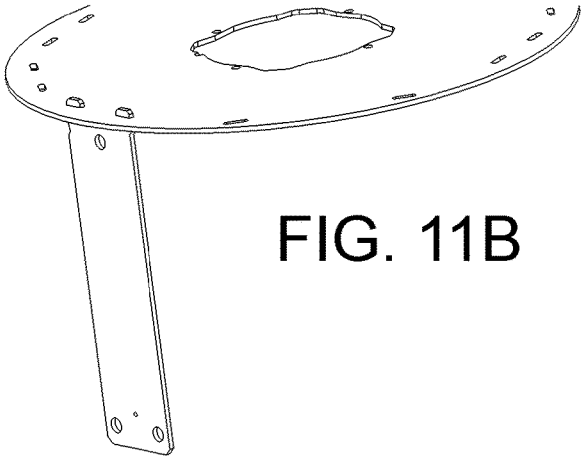
FIG. 11B shows the PCB board and elevated baseplate in an assembled configuration according to some embodiments.

FIG. 11A is a view of an example antenna PCB 610, representative of PCBs of various shapes and sizes, separated from a GPS PCB 530. FIG. 11B shows the antenna PCB and GPS support structure of FIG. 11A in an assembled configuration according to some embodiments. As shown, the antenna board has two PCB fingers 750 which extend from the top of the PCB and are designed to align and mate with corresponding PCB slot 760 in another component. As shown in FIG. 11A, the PCB fingers 750 are shown mating with the PCB slots 760 on the GPS PCB 530. PCB manufacturing is capable of tight tolerances and exact locations allowing these fingers and notches to be precisely located to ensure a tight and accurate fit. The use of this form of assembly provides a rigid structure that resists deformation and vibration and provides a stable platform for the GPS antenna assembly 500 at the top of the antenna array. In some embodiments a single finger can be used. In some embodiments more than two fingers can be used. Other mechanical connecting arrangements can also be used. The mechanical connection preferably provides a low cost, repeatable, predictable, secure, and/or stable connection between the PCB and the top platform. The use of the structural aspects of the antenna PCB board to not only carry the respective antennas, but also to structurally support the GPS platform and position the relative antennas in a spaced configuration provide significant advantages to reduce interference, increase signal reception and transmission, provide a compact design, reduce costs, and increase consistency and repeatability over prior antenna arrays. Modifications can be made to the particular arrangement and mechanical features of PCB boards and mechanical connections described herein consistent with one or more aspects and advantages herein described.

Figure 12:
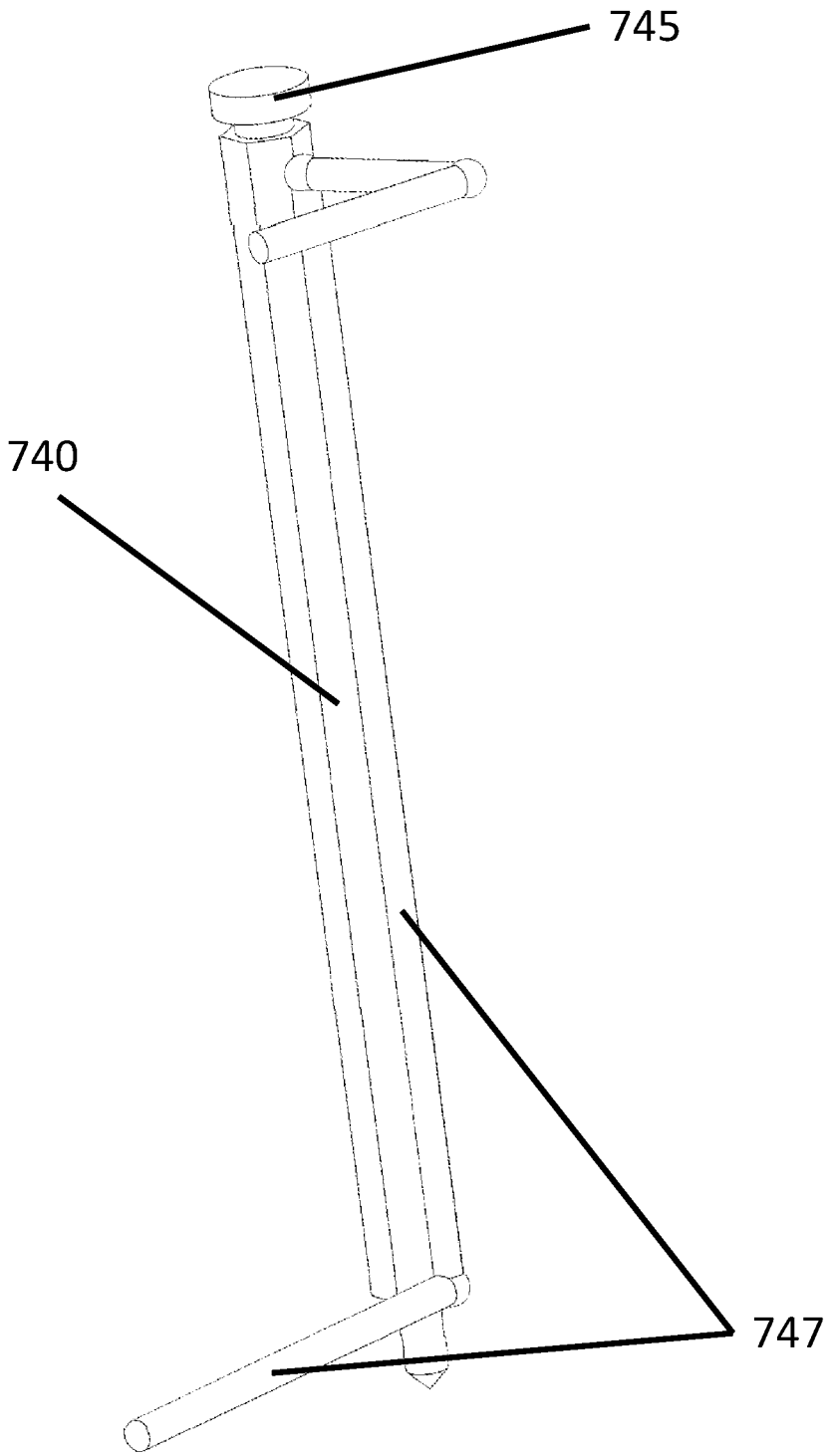
FIG. 12 shows a post for connecting the array baseplate and the elevated baseplate according to some embodiments.

FIG. 12 shows a post 740 for connecting the array baseplate 730 and the GPS support structure 520 according to some embodiments. The post 740 connects the array baseplate 730 to the GPS support structure 520. A post attachment 745, such as a threaded screw or other fastener, may be used to secure the GPS support structure 520 to the post 740. The post 740 could also be attached using solder, glue, or another method of adhering parts together as known to those skilled in the art. A coaxial cable 747 is shown adjacent to the post 740 through which electrical connections may pass to connect to the GPS antenna 500. The post 740 may be made of nylon, plastic, metal, or other material.

Figure 13:
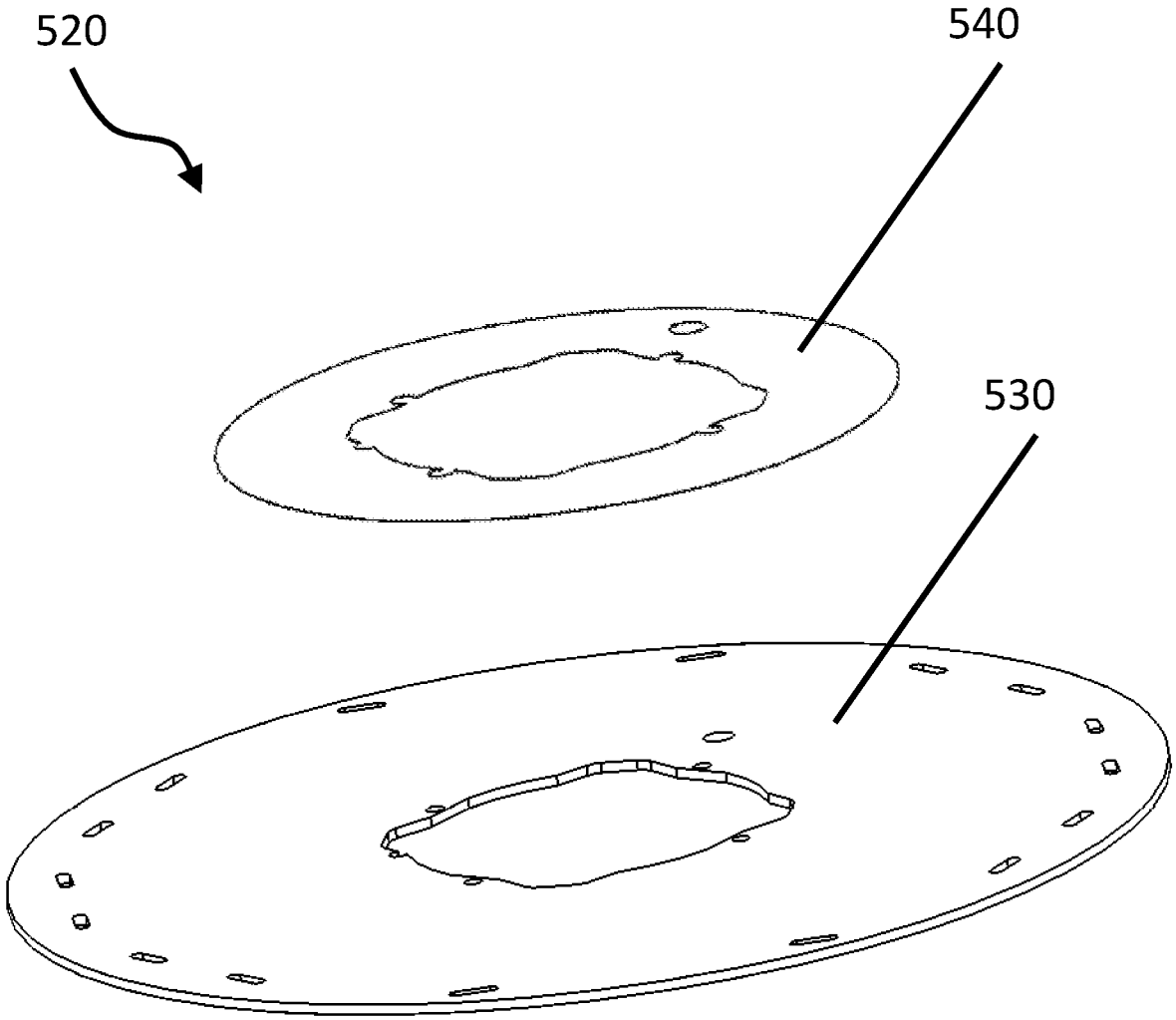
FIG. 13 shows an elevated baseplate and elevated groundplane separated from one another according to some embodiments.

FIG. 13 shows an exploded view of a GPS support structure 520 having a GPS substrate 530 and an elevated groundplane 540 shown separated from one another according to some embodiments. The GPS substrate 530 may be constructed from PCB according to some embodiments. PCB is less expensive than a metal baseplate and provides a manufacturing advantage including locating holes and slots and suspending conductive surfaces. This may reduce the costs to develop a stable antenna array structure. An elevated groundplane 540 is illustrated separate from the GPS substrate 530. However, in some preferred embodiments, to simplify manufacturing and reduce costs, the elevated groundplane 540 can be integrated as part of the of the GPS substrate 530, being formed directly on the PCB to realize the GPS support structure 520 in a uniform component.

Figure 14:
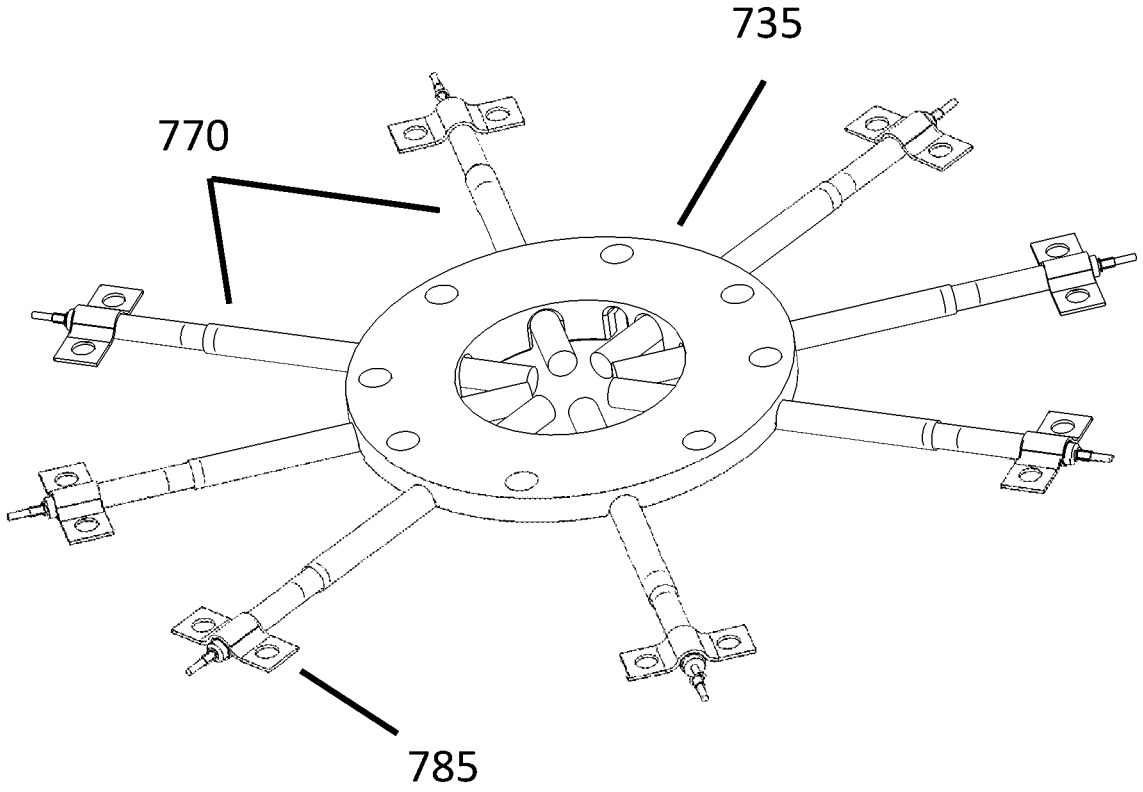
FIG. 14 shows coaxial connectors in a ring for connecting antenna boards around a circumference, periphery, and/or perimeter according to some embodiments.

FIG. 14 shows a plurality of coaxial connectors 770 arranged in a spoke-like configuration extending through and from a central ring guide support 735. The central ring guide support 735 preferably defines slots and/or openings through which the plurality of coaxial connectors extend outwardly for connecting antenna boards around a circumference, perimeter, and/or periphery of the antenna array according to some embodiments. The embodiment shown comprises eight coaxial connections. The central ring guide support 735 may have additional slots to correspond with additional antennas. The central ring guide support is configured to be coupled to the array baseplate and to align the coaxial connectors with the antenna PCBs. The plurality of coaxial connectors are shown with securing ground plates and/or straps 785 to facilitate attachment of the coaxial connectors in a secure position with respect to the baseplate when coupled to the PCBs.

Figure 15:
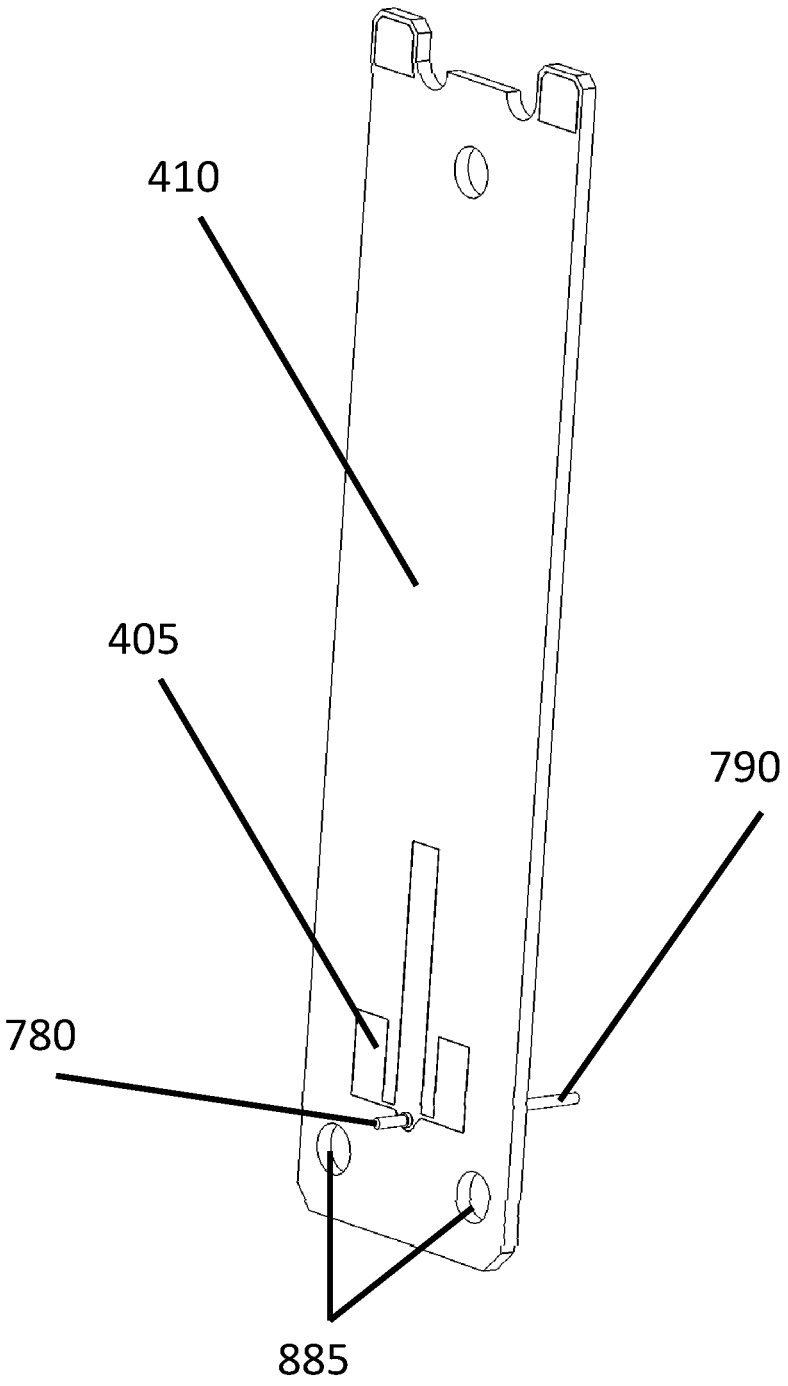
FIG. 15 is an antenna board with the center pin of the coaxial conductor shown inserted into the antenna board according to some embodiments.

FIG. 15 is an antenna board with the center pin 780 of the coaxial cable 790 shown inserted into the antenna board according to some embodiments. The WiFi PCB 410 as shown contains two PCB attachment holes 885 to allow the WiFi PCB 410 to be secured to the array baseplate 730. The WiFi PCB 410 contains a WiFi antenna 405 etched to the PCB 410. Protruding through the WiFi PCB 410 is a center pin 780 coming from the coaxial cable 790. This conduit provides the electrical connection to drive the antenna signal for this antenna. Similar connections are provided for other PCB antennas around the periphery of the array. Alternative electrical connections can be used on some or all of the PCB antennas in other embodiments.

Figure 16:
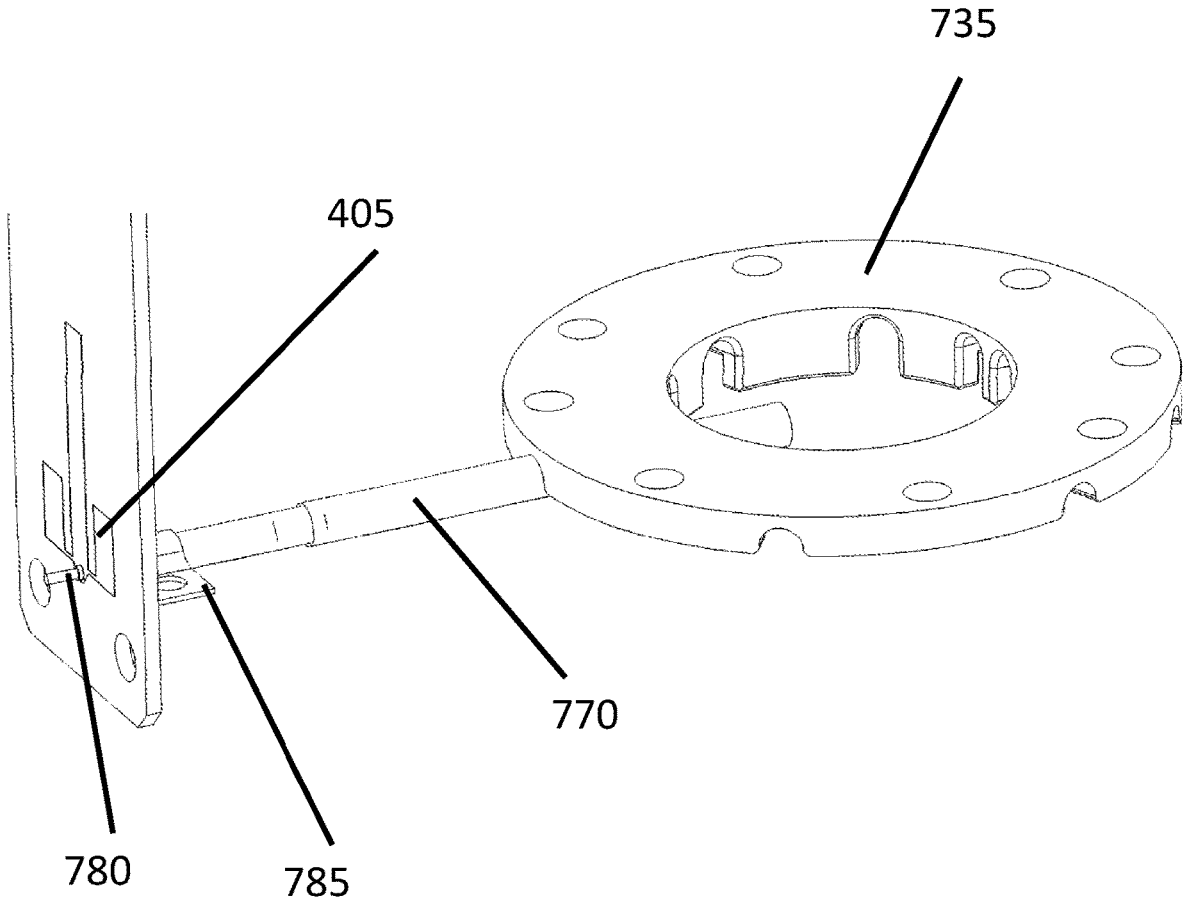
FIG. 16 shows the antenna board and coaxial connection according to some embodiments.

FIG. 16 shows the WiFi antenna board 400 and coaxial connection according to some embodiments. The center pin 780 extends through the WiFi PCB 410 to provide a connection to the WIFI antenna 405 and the ground of the coaxial cable is connected to the array baseplate using a strap 785 and fasteners.

Figure 17:
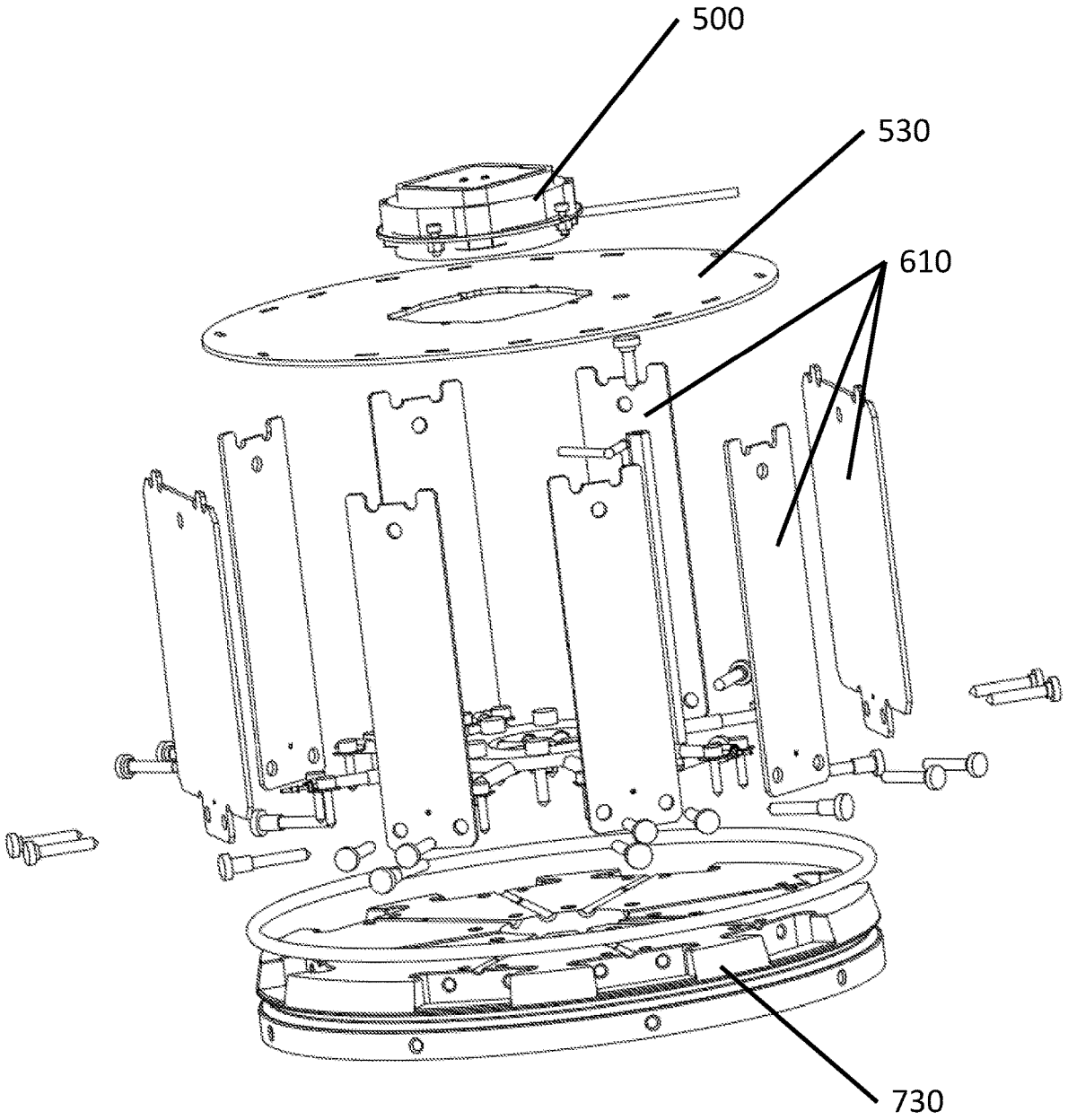
FIG. 17 is an exploded perspective view of some components of an antenna array, without a radome, according to some embodiments

FIG. 17 is an exploded perspective view of some components of an antenna array, without a radome, according to some embodiments. The figure shows an array baseplate 730 and the GPS substrate 530. The GPS antenna assembly 500 is also shown and labeled. The figure depicts eight antenna PCB boards 610 around the perimeter. These PCB boards 610 may contain any of the types of antennas mentioned elsewhere in this document or any other type of antenna used for RF communication in the industry. Although eight antenna PCB boards 610 are shown in a somewhat circular arrangement, other geometric arrangements, or quantities, of antenna boards 610 may be used.

Figure 18A:
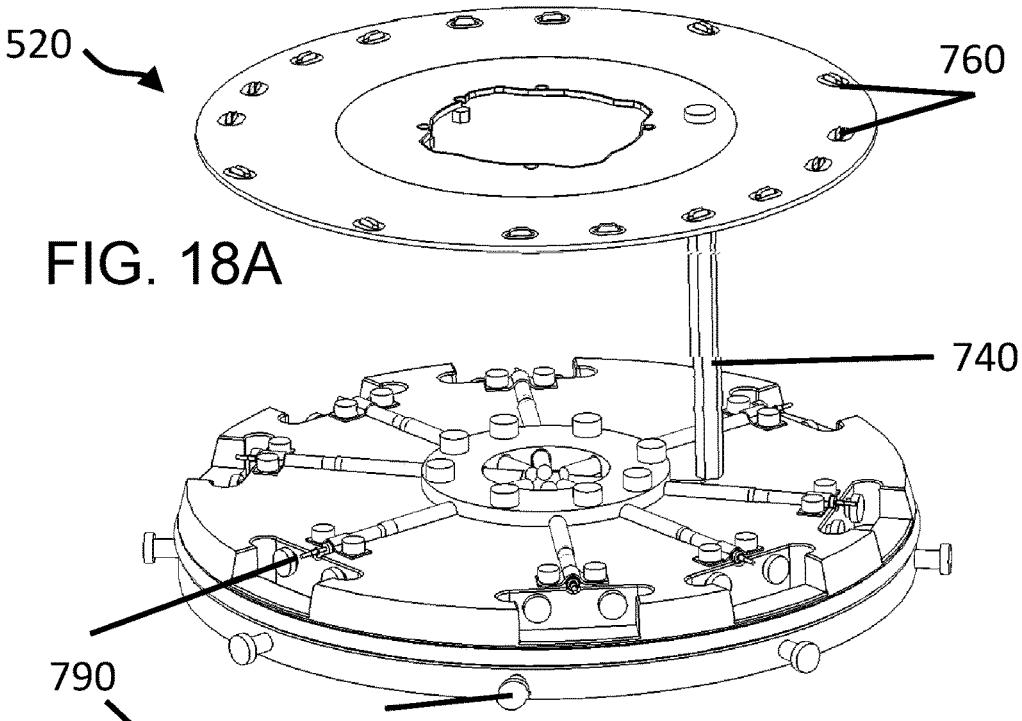
FIG. 18A is a perspective view of the structure for supporting antenna elements without any included antennas according to some embodiments.
Figure 18B:
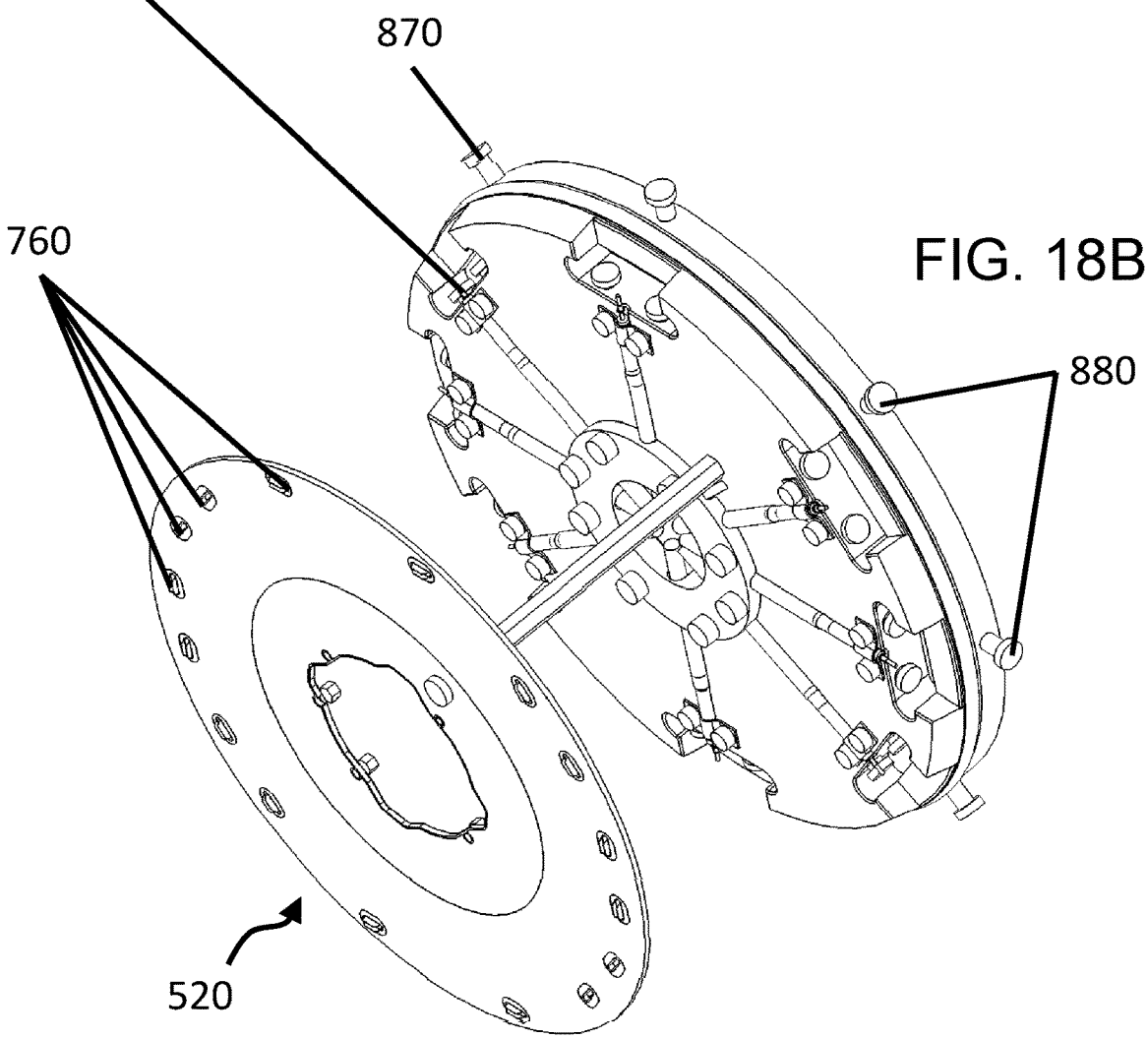
FIG. 18B is another perspective view of the structure for supporting antenna elements without any included antennas according to some embodiments.

FIG. 18A and FIG. 18B are each a perspective view of the structures for supporting antenna elements according to some embodiments. The figures are shown without any included antennas to better view the supporting structures. A post 740 connects the GPS support structure 520 to the array baseplate 730. The GPS support structure 520 contains numerous PCB slots 760 designed to receive corresponding PCB fingers 750 from individual antenna boards not shown in this figure. Coaxial cable 790 extends to the peripheral edge of the array baseplate to connect to each antenna of the array. Around the peripheral edge of the antenna array baseplate 730 are radome fasteners 870. PCB fasteners 880 are preferably arranged and configured to securely attach each antenna board to the array baseplate 730, according to some embodiments. Other suitable connections are also contemplated within the scope of this disclosure as understood by one of skill in the art.

Figure 19:
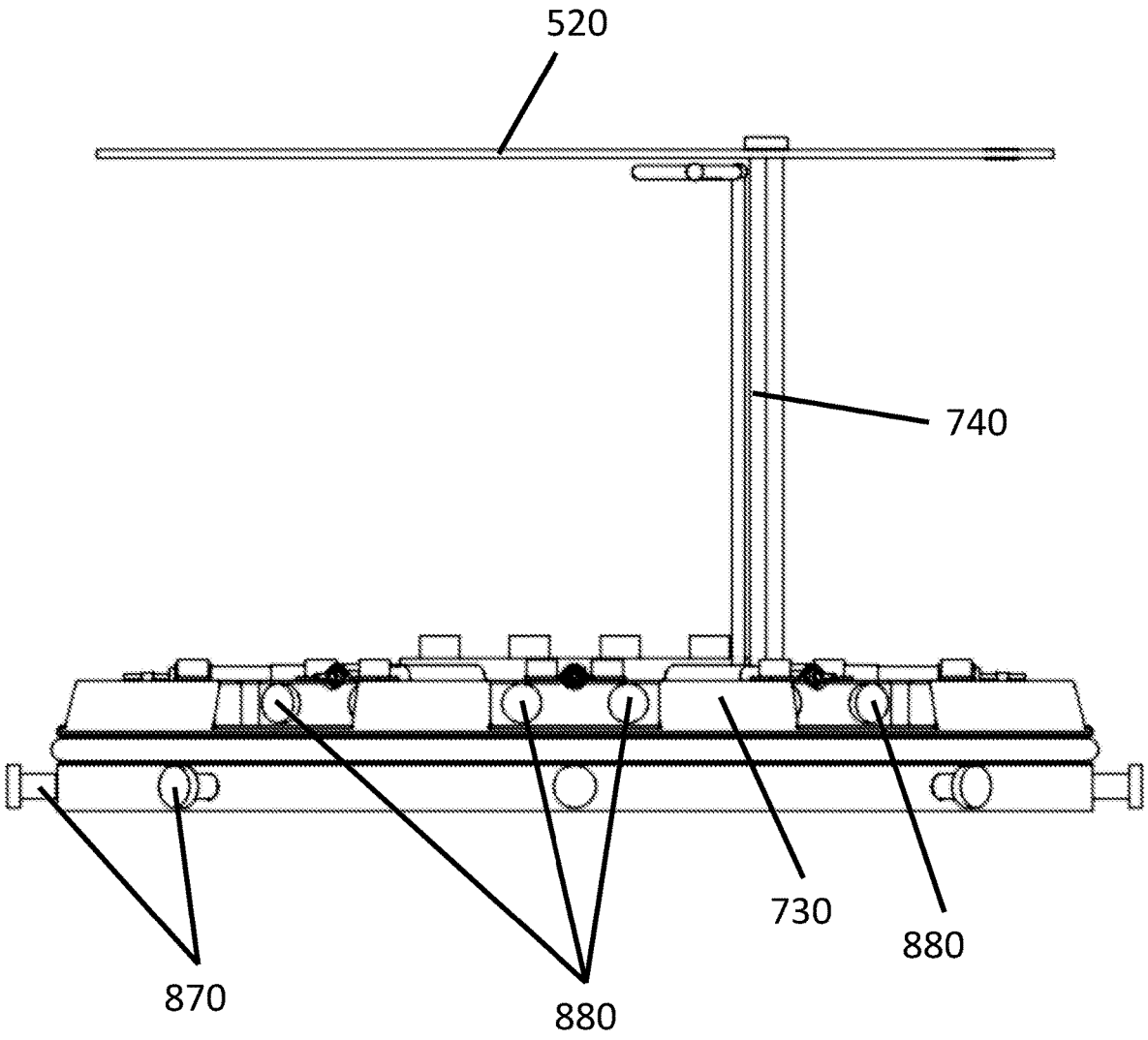
FIG. 19 is a front view of the structure for supporting antenna elements without any included antennas according to some embodiments.

FIG. 19 is a front view of the structure for supporting antenna elements, without any included antennas, according to some embodiments. The GPS support structure 520 is connected to the array baseplate 730 by a post 740. Numerous PCB fasteners 880 are shown which can attach antennas to the array. Radome fasteners 870 are around the outer edge to secure the radome to the antenna array system.

Figure 20:
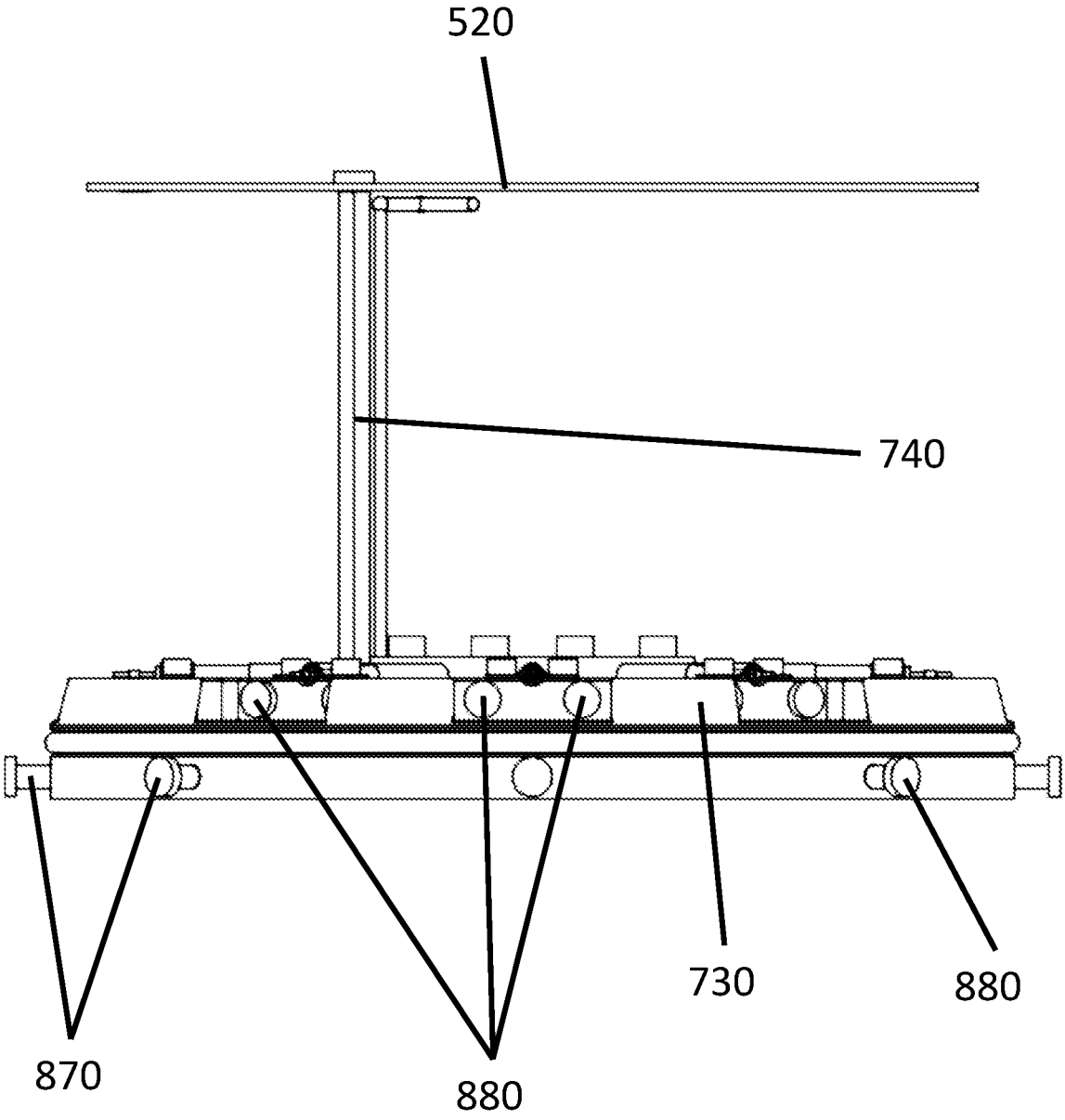
FIG. 20 is a side view of the structure for supporting antenna elements without any included antennas according to some embodiments.

FIG. 20 is a side view of the structure for supporting antenna elements without any included antennas according to some embodiments. The GPS support structure 520 is connected to the array baseplate 730 by a post 740. PCB fasteners 880 may attach individual antenna elements to the array baseplate 730. Radome fasteners 870 surround the peripheral edge of the array baseplate 730.

Figure 21:
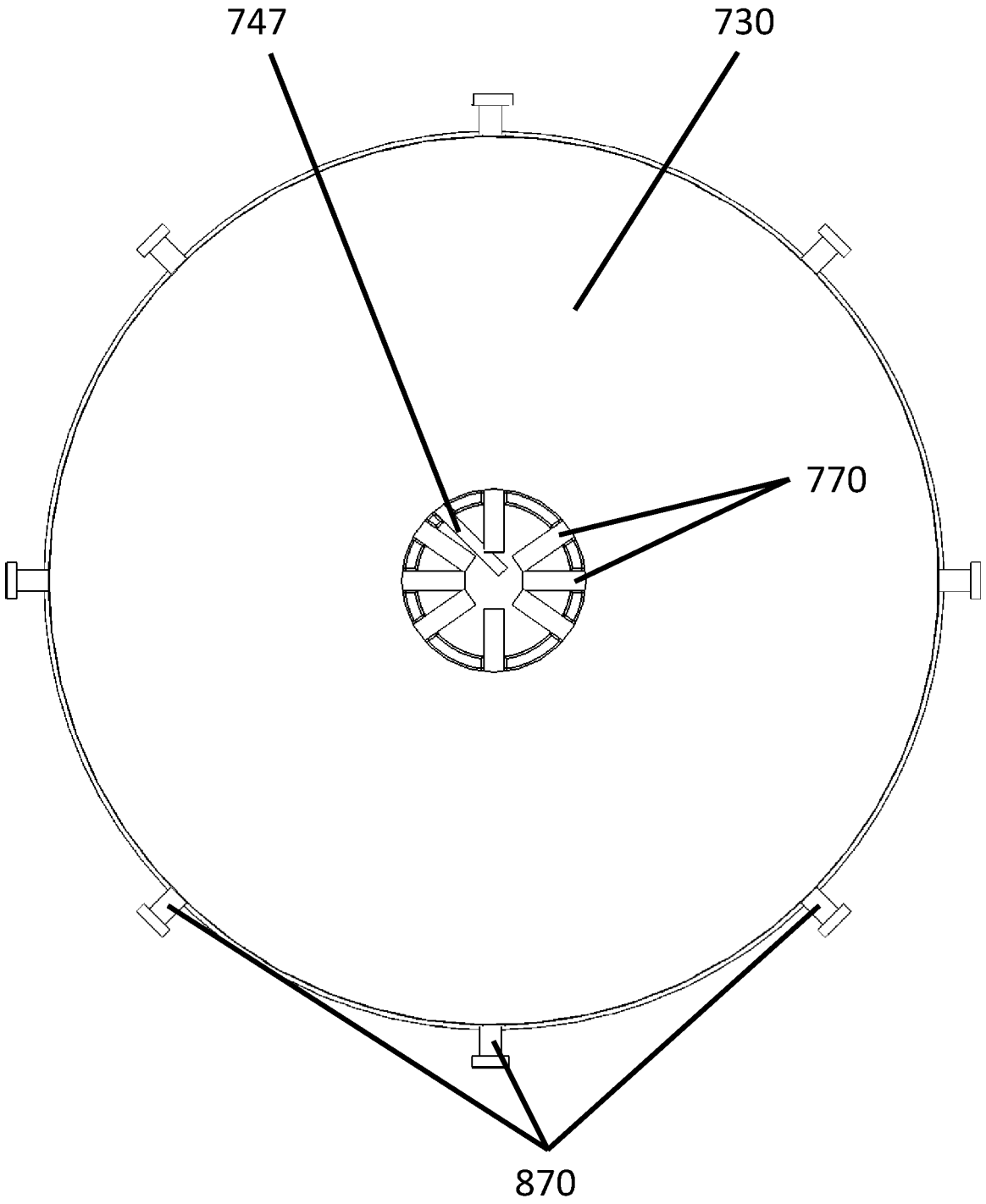
FIG. 21 is a bottom view of the structure for supporting antenna elements without any included antennas according to some embodiments.

FIG. 21 is a bottom view of the structure for supporting antenna elements, according to some embodiments. The array baseplate 730 has radome fasteners 870 around its outer edge. Within the center, the plurality of coaxial cables 770 intersect. The post coaxial cable 747 also meets in the center. The post coaxial cable connects to the GPS antenna 505. The plurality of coaxial connectors 770 that connect to antennas and the post coaxial cable 747 may pass through conduit or another method to the devices controlling their respective antennas. The coaxial connectors 770 and post coaxial cable 747 may terminate in the center and be connected to extension cables. Alternately each of the multiple coaxial cables may extend from their respective antennas and continue from the antenna array to another location.

Figure 22:
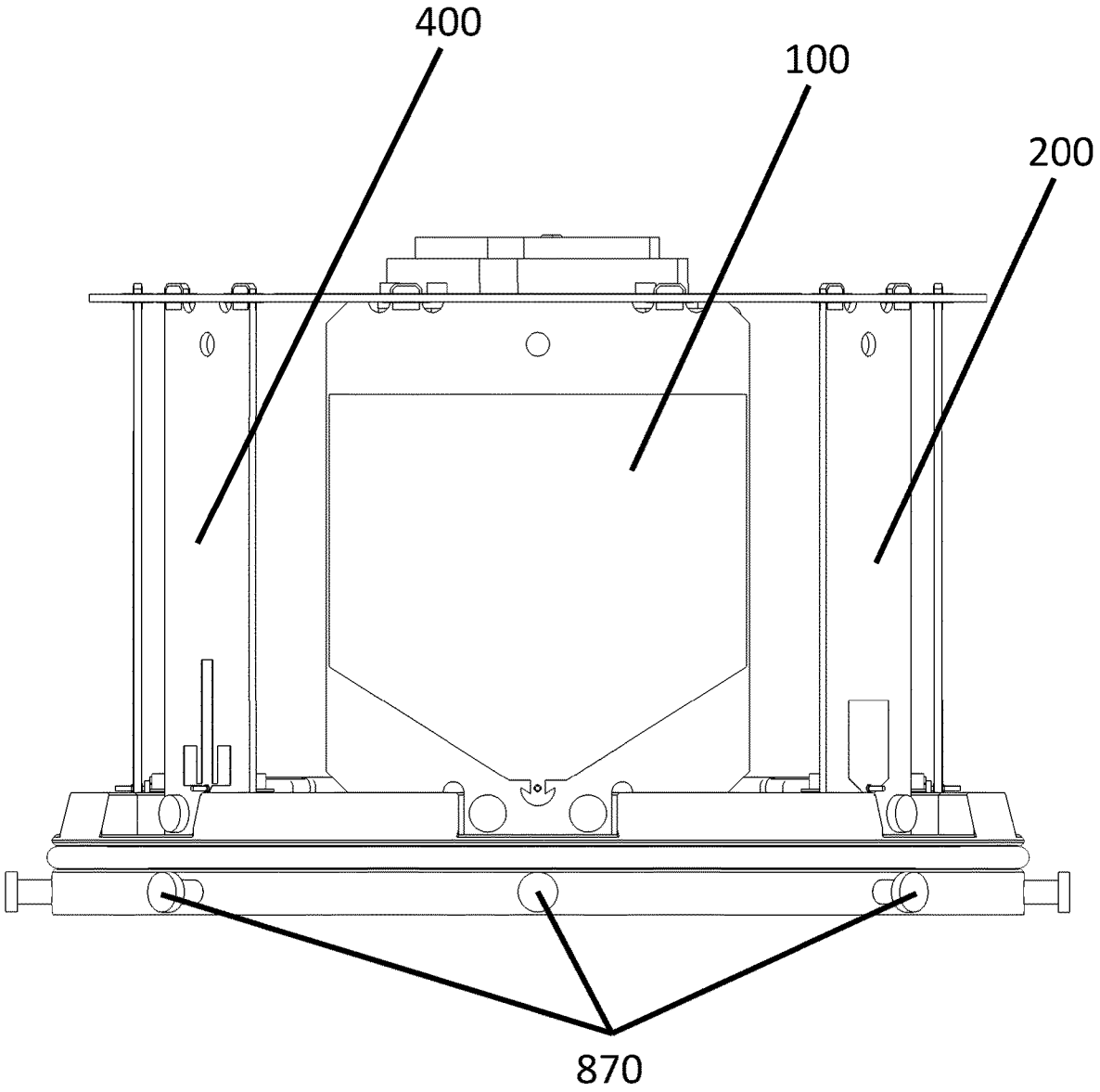
FIG. 22 is a front view of the antenna array without a radome according to some embodiments.

FIG. 22 is a front view of the antenna array without a radome according to some embodiments. A broad band LTE antenna board 100 is prominently visible in the figure. A single band LTE antenna board 200 and dual band WiFi antenna board 400 flank the broad band LTE antenna board 100 as shown. Radome fasteners 870 surround the peripheral edge of the antenna array baseplate 730.

Figure 23:
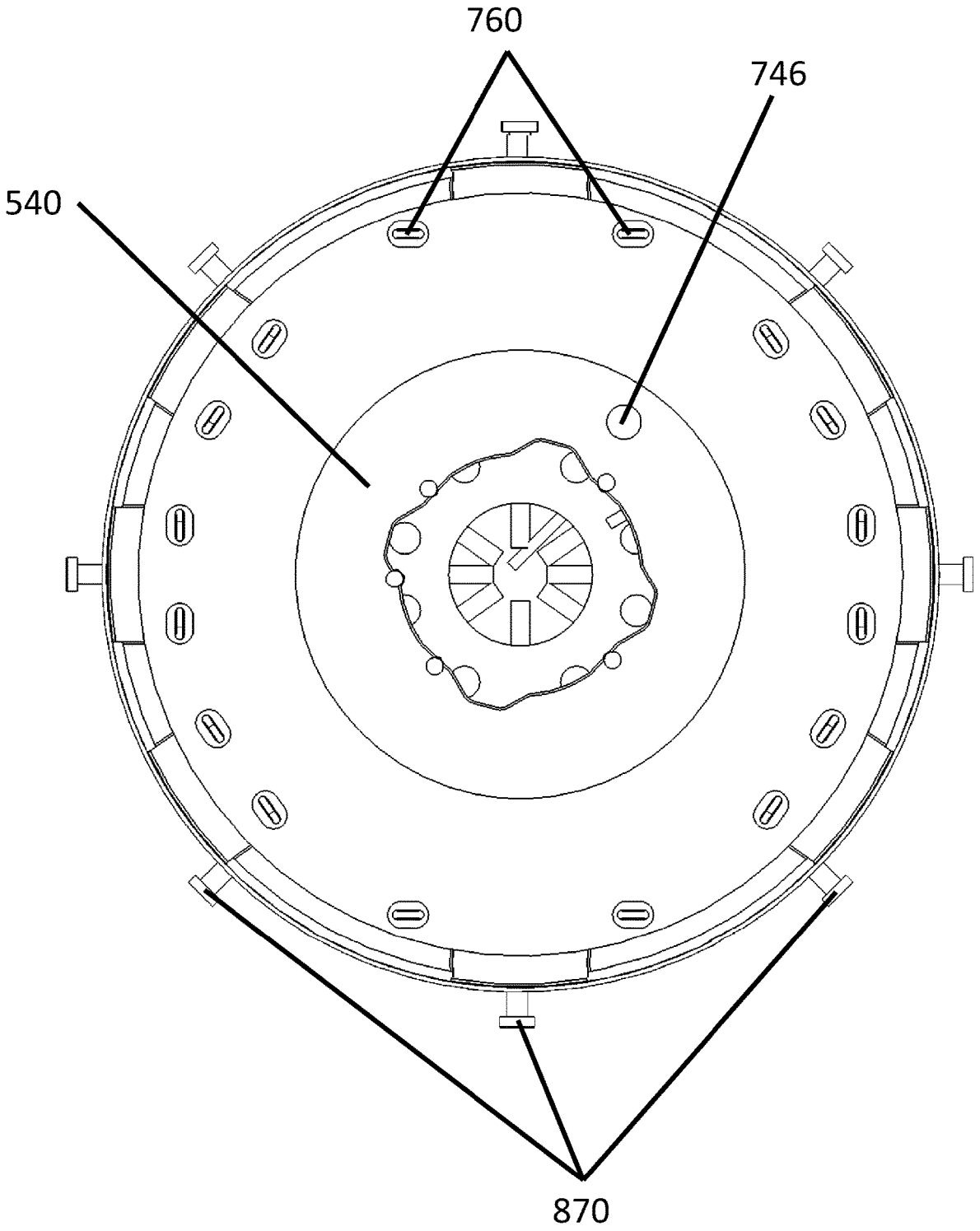
FIG. 23 is a top view of the antenna array without a radome and without a GPS antenna according to some embodiments.

FIG. 23 is a top view of the antenna array without a radome and without a GPS antenna according to some embodiments. A post attachment opening 746 is visible for connecting the GPS support structure 520 to the underlying array baseplate 730. PCB slots 760 surround the circumference mating with the corresponding PCB fingers 750 of each underlying antenna board. The elevated groundplane 540 is in the center of the GPS support structure 520 preferably supported on the GPS PCB substrate 530.

Figure 24:
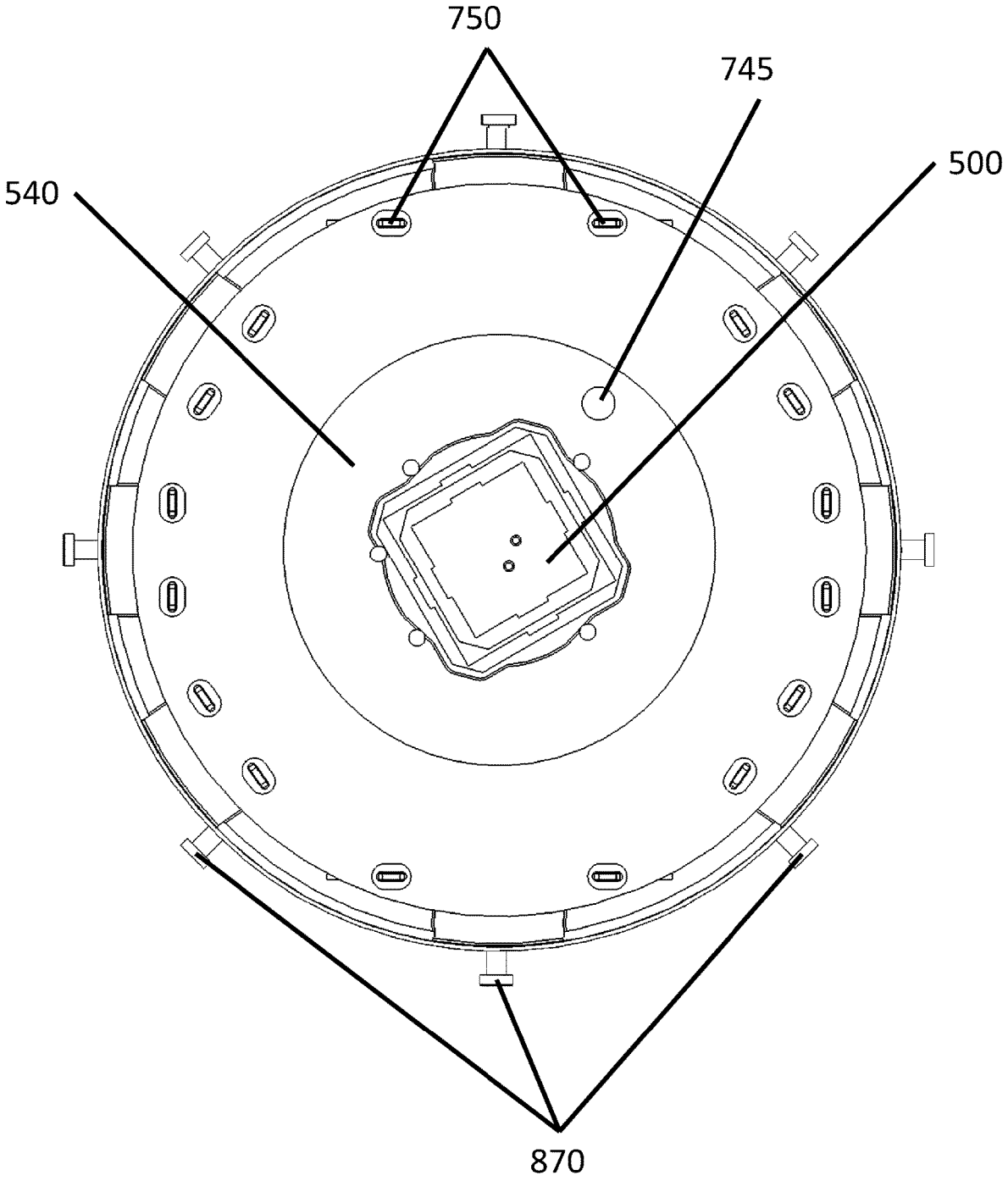
FIG. 24 is a top view of the antenna array without a radome according to some embodiments.

FIG. 24 is a top view of the antenna array without a radome according to some embodiments. The GPS antenna 500 is shown in the center of the elevated groundplane 540 on the GPS support structure 520.

Figure 25:
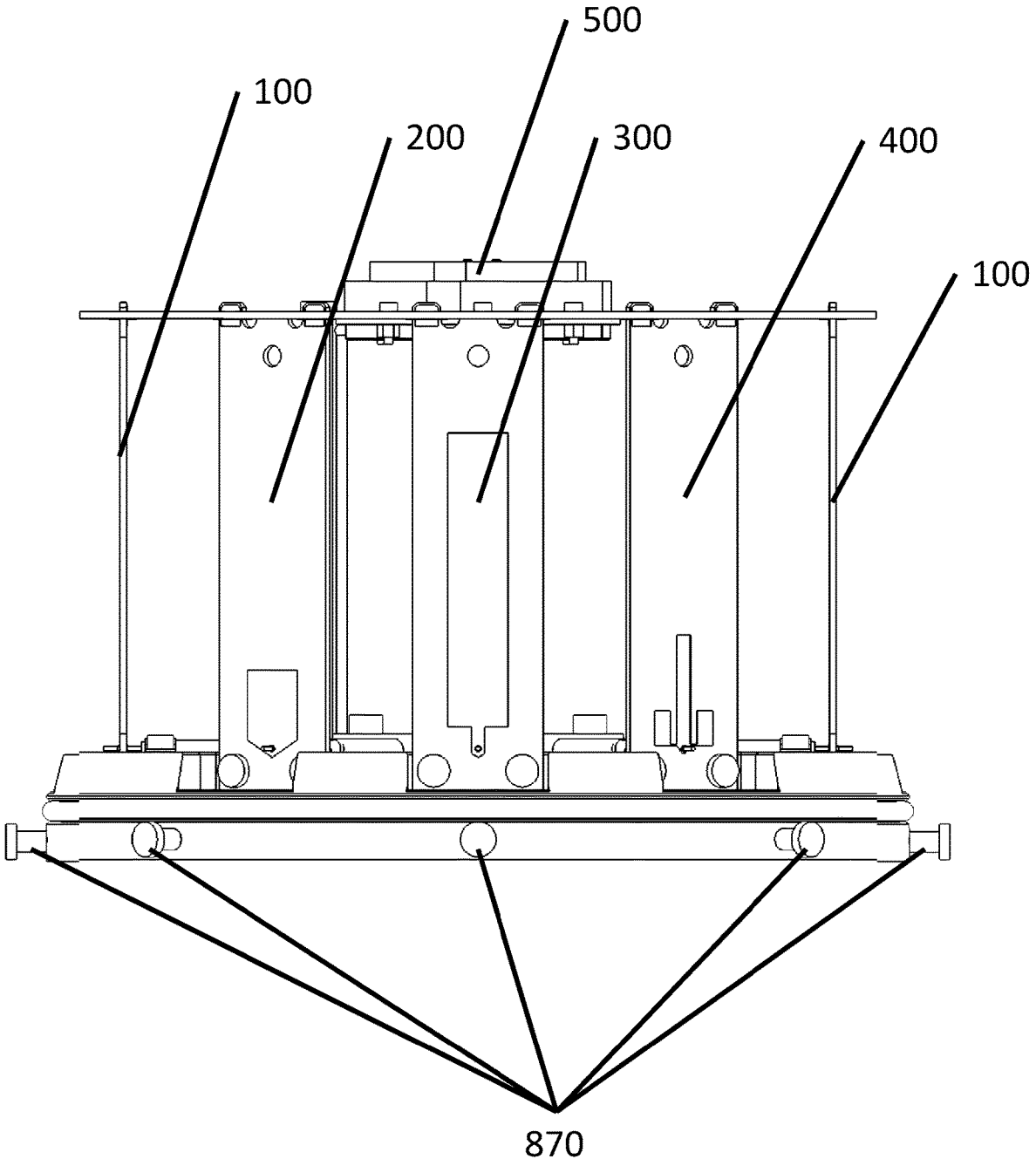
FIG. 25 is a side view of the antenna array without a radome according to some embodiments.

FIG. 25 is a side view of the antenna array without a radome according to some embodiments. Radome fasteners 870 surround the peripheral edge of the antenna array baseplate 730. According to some embodiments, array antenna types may be duplicated as illustrated in FIG. 25. The antenna array contains side views of two broad band LTE antenna boards 100, a WiFi antenna board 400, a single band LTE antenna board 200, a 900 MHz ISM band antenna board 300, and a GPS antenna 500.

Figure 26:
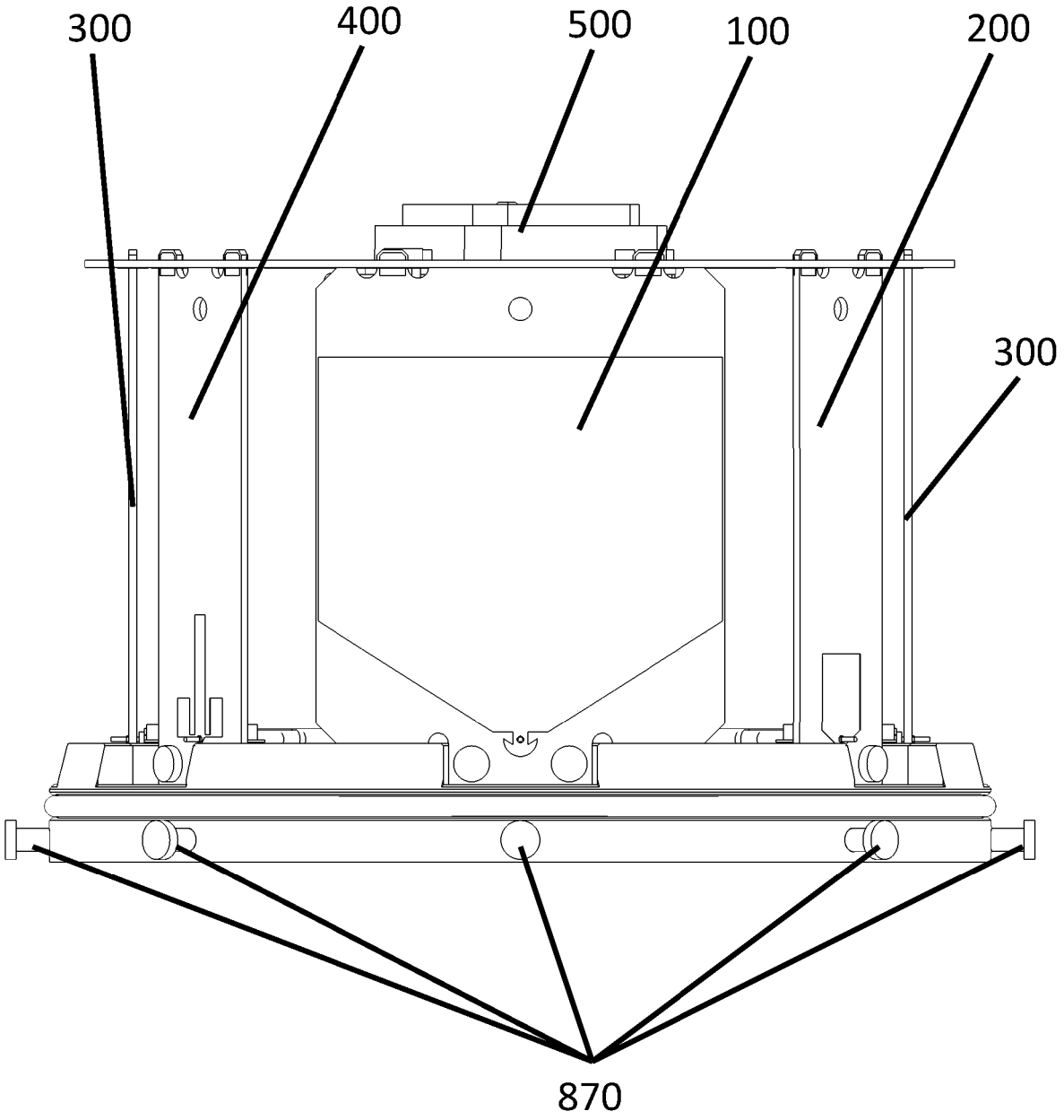
FIG. 26 is another side view of the antenna array without a radome according to some embodiments.

FIG. 26 is a side view of the antenna array without a radome according to some embodiments. The antenna array illustrated in the figure contains two each of four types of antennas. The array comprises two broad band LTE antenna boards 100, one of which is visible, two WiFi antenna boards 400, one of which is visible, two single band LTE antenna boards 200, one of which is visible, and two 900 MHz ISM band antenna boards, both of which are visible.

Figure 27:
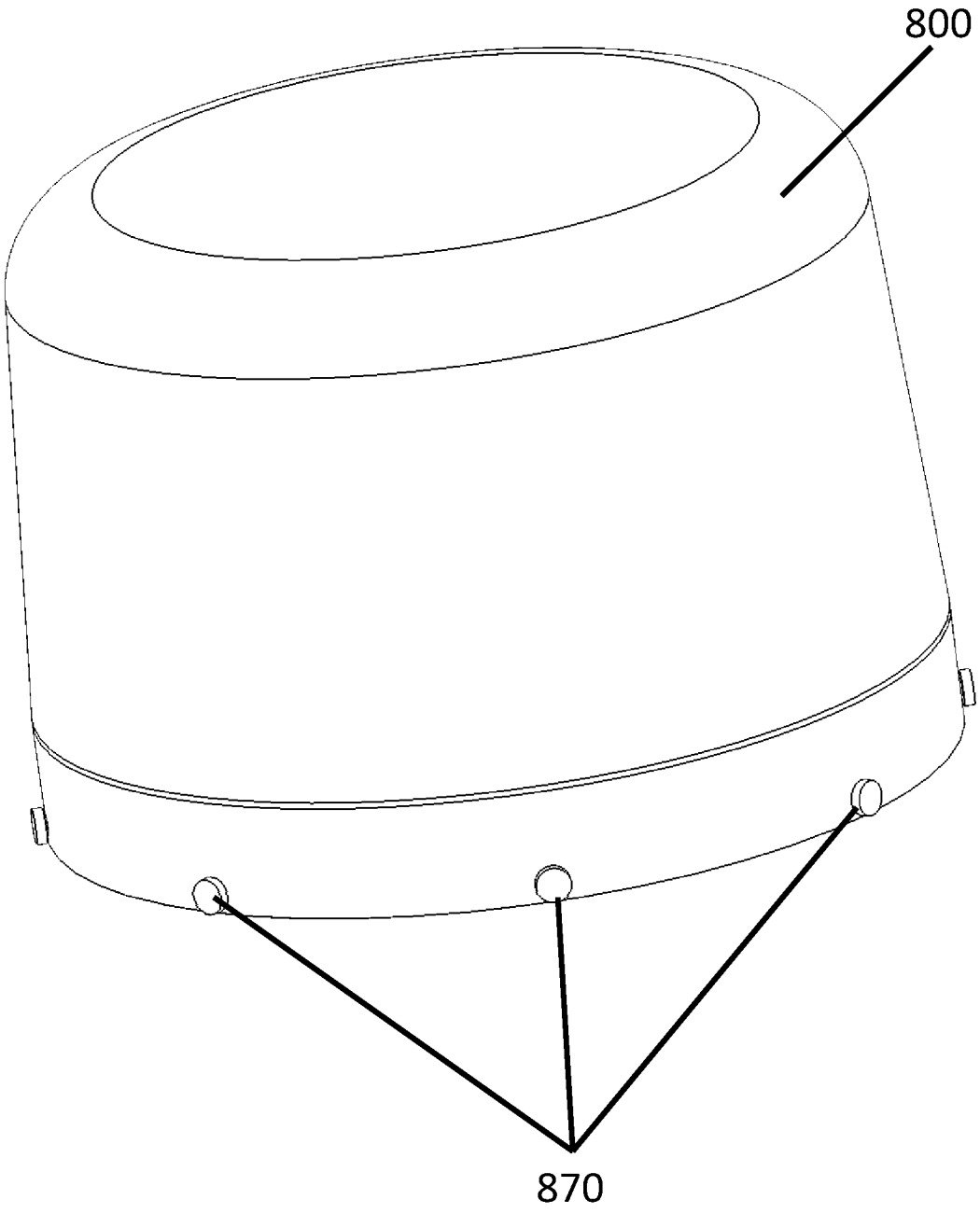
FIG. 27 is a view of an antenna array surrounded by a radome according to some embodiments.

FIG. 27 is a view of an antenna array surrounded by a radome 800 according to some embodiments. The radome 800 may be secure to the baseplate 730 by radome fasteners 870. The radome protects and/or shields the antenna array without unduly interfering with antenna signals.

Providing the GPS its own groundplane 540 above all the other antenna elements in the communication array increases the location accuracy of the GPS array in some preferred embodiments. This also reduces the amount of coupling between the GPS antenna and the communication array in some preferred embodiments, which improves the signal of the communications antennas as well as the performance of the GPS antenna.

In some embodiments, a support structure 520 for the GPS antenna is better than a plate of aluminum or other alternatives. PCB can be as strong as aluminum. PCB can also be cut and shaped with higher tolerances than metal. PCB is lighter than aluminum. Copper traces on a PCB are subject to high accuracy and accurately work as a groundplane in some preferred embodiments.

Not only is aluminum heavier than an equivalent sized piece of PCB but it has lower tolerances in manufacturing and cutting. These lower tolerances mean that there is greater flexibility and stress when combining pieces together. There can also be difficulties ensuring repeatability when manufacturing items based on the reduced tolerances, leading to greater flex in the combined components.

Elevating the elevated groundplane 540 above the communication antennas improves the horizontal radiation pattern of the communication antennas. Placing an additional groundplane above the communications array partially reflects the signal of the multi-antenna array focusing their radiation pattern toward the horizontal plane and decreasing the wasted energy directed towards the sky. This creates an added benefit for placing the GPS antenna above the other array elements.

Contrary to the recommendations of some GPS manufacturers, an aluminum groundplane plate is not necessary and can be eliminated or avoided according to some embodiments. Attaching a GPS antenna to a PCB and a groundplane integrated with that PCB is suitable and sufficient to meet the tolerances for high accuracy GPS implementations.

In some embodiments, manufacturing or providing a PCB for the elevated baseplate creates an opportunity to utilize or create custom PCB boards for the other antennas in a communications array. For example, some embodiments have multiple custom PCBs that increase the matching between antennas and take into account the interaction between the various antenna elements so that they are appropriately spaced, positioned, and configured to properly reinforce each other and provide an enhanced signal. Such improvements are possible due to the simplification of the design considerations by elevating the GPS system to be essentially out of the way of the communication antennas in the system array.

Use of an elevated PCB board with its own groundplane for the GPS antenna 505 can contribute to controlling the costs of the overall system. The structural support provided by the GPS support structure 520 and supporting antenna PCB boards may improve the rigidity of the overall assembly and may decrease the number of additional support members necessary to stabilize the structure.

In some embodiments, a nylon post 740 in the center of the antenna array may extend perpendicular to the array baseplate 730 and connect the elevated baseplate 530 to the array baseplate 730. This post 740 may be used to connect cabling to the GPS antenna 505, such as the post coaxial cable 747 illustrated in FIG. 12, to prevent, minimize, and/or limit movement of the coaxial cable. In some embodiments, the multi-modal arrays on the periphery of the system preferably interlock with the PCB of the GPS antenna baseplate 530 by mating PCB fingers 750 to PCB slots 760 providing structural strength. The use of a post 740 and screws, or other fasteners, can tie all of these components together, creating a firm and stable unstressed environment which can then be used to solder the various components together. Soldering components attached in an unstressed condition creates better connections that are more stable and less likely to degrade over time. The use of the post 740 also provides vibration dampening for the entire assembly and reduces the wear and tear on the interconnections between the PCBs, the soldering joints, and the coaxial cable. The post 740 may be made of materials other than nylon.

The interlocking components of the multimodal antenna PCBs (e.g. 100, 200, 300, and 400) with the GPS support structure 520 above create enhanced structural rigidity. Placing antennas around the periphery of a cylinder, in some embodiments, creates numerous, triangular-shaped structures that improve the stability and resistance to collapse of the overall structure. These improvements increase the overall strength and resistance to damage of the system and provide repeatable and stable antenna performance. Providing a compact protective radome protects the system and provides for a simple repeatable installation of a multiple antenna array on a vehicle or mobile structure.

Vehicles and/or other mobile structures for which GPS location capabilities and/or RF communication functionality is desirable can be outfitted with a compact, efficient, effective antenna array according to aspects of the disclosure provided herein. An elevated GPS system mounted on a vehicle above a base supported by multiple different PCB antennas provides enhanced GPS signal accuracy, limits antenna shadowing and interference, enhances communication, and significantly reduces material and installation costs. Such compact mobile antenna array systems provide enhanced vehicle tracking, monitoring, control, and enhanced communication and data access, including enhanced inter-vehicle communication and remote system controls and guidance. Improved signal transmission and reception provides faster more accurate communication and enhances precision processing. Vehicles with advantageously mounted PCB antennas can be configured for enhanced horizontal and/or directional signaling with reduced installation and maintenance costs. The simplified construction and design facilitates installing a customized array of multiple individual antennas on top of a vehicle with secure electrical connections that can avoid creating numerous pathways, cabling and arrangement requirements associated with other complex antenna systems. The elevated GPS antenna achieves greater accuracy in the location of the vehicle by having a clear line-of-sight to the horizon. This enables the GPS to receive as many satellite signals as possible. Placing the GPS antenna element and its elevated groundplane above all the other antenna elements in the communication array reduces the amount of coupling between the GPS element and the communication array which further improves the accuracy of the GPS and therefore improves accuracy in the perceived location of the vehicle. Another advantage of raising the GPS element and its groundplane above the communication elements is that the performance of all the antenna elements in the array may improve as well. Elevating the GPS element above the surrounding elements effectively eliminates interference and provides technical advantages and cost savings. Using PCB and etched antenna components in an elevated PCB that contains its own integrated groundplane advantageously can also serve as a mechanical structure to lock all the supporting antenna elements in place with a structurally secure, precise configuration that is lighter, more compact, more secure, and more cost effective than other antenna arrays.

For example, according to some embodiments, a vehicle with a mobile mounted antenna array can have one or more of the following antenna components: a compact antenna array radome, an antenna array comprising up to eight or more communication PCB antennas, such as one or more broad band LTE antenna boards, one or more WiFi antenna boards, one or more single band LTE antenna boards, one or more 900 MHz ISM antenna boards, an elevated GPS antenna, an elevated GPS groundplane, PCB antennas providing structural support for the elevated GPS antenna, a slotted elevated PCB base as GPS support, elevated GPS groundplane etched on an elevated GPS support board, coaxial cable pin connections to the PCB antennas at the periphery of the antenna array to electrically couple the respective PCB communication antennas supporting the elevated GPS antenna, PCB fasteners configured to affix one or more antenna boards to the array baseplate and or to the GPS support, and/or radome fasteners for securing a radome to the antenna array.

According to some advantageous aspects, the features and components of this disclosure provide for novel systems and methods. In some aspects, methods of manufacturing an antenna array system include one or more steps disclosed herein such as, for example, providing an elevated GPS antenna, providing an elevated groundplane, providing circumferentially spaced opposing communication PCB antenna pairs as described herein to support an elevated groundplane and/or GPS antenna, providing a central space defined within the spaced antenna pairs void of an antenna, and/or void of a GPS antenna, coupled to the common base of the spaced antenna pairs between the antenna pairs, providing communication PCB antennas as support structures for an elevated GPS antenna system and groundplane, and/or providing other features and elements of the systems as described herein.

In some aspects, methods of using an antenna array system include one or more steps disclosed herein such as, for example, mounting and/or providing a disclosed antenna array system on a vehicle, mounting and/or providing a disclosed antenna array system on a mobile structure, transmitting or receiving RF signals using a disclosed antenna array system, communicating with a vehicle using a disclosed antenna array system, navigating a vehicle using a disclosed antenna array system, monitoring and/or tracking a mobile device using a disclosed antenna array system, processing data provided to or from a vehicle using a disclosed antenna array system, generating, transmitting and/or receiving RF signals using a plurality of unique antennas of the disclosed antenna systems simultaneously and/or in series, executing a financial transaction using a disclosed mobile antenna array, collecting, storing, and/or transmitting sensed data from a vehicle equipped with one or more cameras and/or sensors and a disclosed mobile antenna array system, and or accessing other features and elements of the systems as described herein.

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

The various features and processes described herein may be used independently of one another, or may be combined in various ways. All possible combinations and sub-combinations are intended to fall within the scope of this disclosure. The example systems and components described herein may be configured differently than described. For example, elements may be added to, removed from, or rearranged compared to the disclosed example embodiments.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, and so forth, may be either X, Y, or Z, or any combination thereof (for example, X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

It should be emphasized that many variations and modifications may be made to the herein-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated herein, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

Those of skill in the art would understand that information, messages, and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

What is claimed is:

1. A mobile antenna system for radio frequency communication, the system comprising:

a first baseplate in a first plane defining a first groundplane;

an elevated second baseplate in a second plane and spaced above the first plane in use, the elevated second baseplate defining an elevated second groundplane, the elevated second baseplate comprising a printed circuit board;

a plurality of support antennas positioned between the first baseplate and the elevated second baseplate, the plurality of support antennas each comprising a printed circuit board, the plurality of support antennas comprising a first pair of antennas configured to work within a first range of frequencies, a second pair of antennas configured to work within a second range of frequencies different from the first range of frequencies, and a third pair of antennas configured to work within a third range of frequencies different from the first and second range of frequencies, the plurality of support antennas having respective base portions coupled to the first baseplate and respective upper portions coupled to the elevated second baseplate; and an elevated GPS antenna positioned above the elevated second baseplate in use, the elevated GPS antenna configured to work within a GPS range of frequencies different from the plurality of support antennas ranges of frequencies, the elevated GPS antenna having a base portion coupled to the elevated second baseplate.

2. The system of claim 1, wherein the pairs of antennas are selected from a group consisting of broad band LTE antennas, single band LTE antennas, WiFi antennas, and 900 MHz ISM antennas.

3. The system of claim 1, wherein the pairs of antennas are positioned opposite one another along a periphery of the first baseplate in use.

4. The system of claim 1, comprising a vehicle coupled to the first baseplate.

5. A mobile antenna system, comprising:

a first baseplate in a first plane defining a first groundplane;

an elevated second baseplate in a second plane and spaced above the first plane in use, the elevated second baseplate defining an elevated second groundplane;

a plurality of support antennas positioned between the first baseplate and the elevated second baseplate, the plurality of support antennas comprising at least a first antenna configured to work within a first range of frequencies and a second antenna configured to work within a second range of frequencies different from the first range of frequencies, the first and second antennas having respective base portions coupled to the first baseplate; and an elevated GPS antenna positioned above the elevated second baseplate in use, the elevated GPS antenna configured to work within a GPS range of frequencies different from the plurality of support antennas ranges of frequencies, the elevated GPS antenna having a base portion coupled to the elevated second baseplate.

6. The system of claim 5, wherein the elevated second baseplate comprises a printed circuit board.

7. The system of claim 5, wherein the first and second antennas comprise respective printed circuit boards.

8. The system of claim 5, wherein the first and second antennas have respective upper portions mechanically coupled to the elevated second baseplate.

9. The system of claim 5, wherein each of the first and second antennas includes at least one of a broad band LTE antenna, a single band LTE antenna, a WiFi antenna, and a 900 MHz ISM antenna.

10. The system of claim 5, wherein the plurality of support antennas comprises a broad band LTE antenna, a single band LTE antenna, a WiFi antenna, and a 900 MHz ISM antenna.

11. The system of claim 5, wherein the plurality of support antennas comprises a pair of broad band LTE antennas, a pair of single band LTE antennas, a pair of WiFi antennas, and a pair of 900 MHz ISM antennas.

12. The system of claim 5, wherein the plurality of support antennas comprises at least a third antenna configured to work within the first range of frequencies of the first antenna, and comprises at least a fourth antenna configured to work within the second range of frequencies of the second antenna.

13. The system of claim 12, wherein the first antenna is positioned opposite the third antenna along a periphery of the first baseplate in use, and wherein the second antenna is positioned opposite the fourth antenna along the periphery of the first baseplate in use.

14. The system of claim 5, wherein the elevated second baseplate defines at least one opening, and wherein at least one of the plurality of support antennas comprises an extension shaped to fit into the at least one opening in the elevated second baseplate.

15. The system of claim 5, comprising a vehicle coupled to the first baseplate.

16. A method of manufacturing a mobile antenna system, comprising:

providing a first baseplate in a first plane defining a first groundplane;

providing an elevated second baseplate in a second plane and spaced above the first plane in use, the elevated second baseplate defining an elevated second groundplane;

coupling a plurality of support antennas between the first baseplate and the elevated second baseplate, the plurality of support antennas comprising at least a first antenna configured to work within a first range of frequencies and a second antenna configured to work within a second range of frequencies different from the first range of frequencies; and coupling a GPS antenna above the elevated second baseplate for GPS use, the GPS antenna configured to work within a GPS range of frequencies different from the plurality of support antennas ranges of frequencies.

17. The method of claim 16, wherein each of the first and second antennas includes at least one of a broad band LTE antenna, a single band LTE antenna, a WiFi antenna, and a 900 MHz ISM antenna.

18. The method of claim 16, comprising coupling the first baseplate to a vehicle.

19. A method of using a mobile antenna system, comprising:

transmitting or receiving RF signals to or from a first antenna of a mobile antenna system within a first frequency range, the first antenna being mounted between a first baseplate positioned within a first plane defining a first groundplane and an elevated second baseplate in a second plane spaced above the first plane in use, the elevated second baseplate defining an elevated second groundplane;

transmitting or receiving RF signals to or from a second antenna of the mobile antenna system within a second frequency range different from the first frequency range, the second antenna being mounted between the first baseplate and the elevated second baseplate; and transmitting or receiving RF signals to or from a GPS antenna of the mobile antenna system within a GPS frequency range different from the first and second frequency ranges, the GPS antenna being mounted above the elevated second baseplate.

20. The method of claim 19, wherein transmitting or receiving RF signals to or from one or more of the first antenna, the second antenna, and the GPS antenna is performed while the mobile antenna system is coupled to a vehicle in motion.

* * * * *